US006514009B2

(12) United States Patent
Northcott et al.

(10) Patent No.: US 6,514,009 B2
(45) **Date of Patent: *Feb. 4, 2003**

(54) SUBTERRANEAN STORAGE VESSEL SYSTEM

(75) Inventors: Robert William Northcott, Calgary (CA); Grant M. Askin, Jarvis Bay (CA)

(73) Assignee: Robert William Northcott, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/846,905

(22) Filed: Apr. 30, 2001

(65) Prior Publication Data

US 2002/0009330 A1 Jan. 24, 2002

Related U.S. Application Data

(63) Continuation-in-part of application No. 09/204,183, filed on Dec. 3, 1998, now Pat. No. 6,254,309.

(30) Foreign Application Priority Data

Dec. 1, 1998 (CA) ..... 2254713

(51) Int. Cl.[7] ..... B65D 88/76
(52) U.S. Cl. ..... 405/53; 220/23.91
(58) Field of Search ..... 405/210, 52, 53, 405/23.91; 220/565, 567.1, 567.2, 567.3

(56) References Cited

U.S. PATENT DOCUMENTS

| | | | | |
|---|---|---|---|---|
| 2,748,739 A | | 6/1956 | Monti et al. | |
| 2,990,796 A | | 7/1961 | Cole et al. | |
| 3,665,721 A | | 5/1972 | Wyllie | |
| 4,190,072 A | | 2/1980 | Fernandez et al. | |
| 4,374,478 A | * | 2/1983 | Secord et al. | 220/565 |
| 4,632,603 A | | 12/1986 | Baugh | |
| 4,934,866 A | | 6/1990 | Gage | |
| 4,961,293 A | | 10/1990 | House et al. | |
| 5,037,239 A | | 8/1991 | Olsen et al. | |

(List continued on next page.)

FOREIGN PATENT DOCUMENTS

| | | |
|---|---|---|
| IT | 0436238 | 9/1949 |
| IT | 0623712 | 8/1961 |

OTHER PUBLICATIONS

Brochure entitled "Protecting Your Business, Preserving the Environment—GREENTANK (TM)—Double–Wall Oilfield Service Tank Systems", ZCL Fiberglass, a division of ZCL Composites Inc., undated, 3 pages.

(List continued on next page.)

*Primary Examiner*—Frederick L. Lagman
(74) *Attorney, Agent, or Firm*—Terrence N. Kuharchuk; Rodman & Rodman

(57) ABSTRACT

A storage vessel system for subterranean installation and a method for constructing such a system. The system includes a storage vessel and a support structure for supporting the storage vessel so that the weight of the storage vessel and any upward buoyancy force applied to the storage vessel are both transferred to the support structure. More particularly, the support structure defines a vessel housing and the storage vessel is contained within the vessel housing. The support structure includes a bearing surface adapted for contacting the ground so that the system is supported on the ground, a vessel anchor for anchoring the storage vessel so that the upward buoyancy force applied to the storage vessel is transferred to the support structure, an exterior shell which permits an infiltrating fluid to infiltrate the vessel housing, and a packing material contained within the vessel housing by the exterior shell and substantially surrounding the storage vessel in order to protect and support the storage vessel.

42 Claims, 7 Drawing Sheets

U.S. PATENT DOCUMENTS

| | | | | | |
|---|---|---|---|---|---|
| 5,271,493 | A | | 12/1993 | Hall | |
| 5,391,019 | A | | 2/1995 | Morgan | |
| 5,421,671 | A | * | 6/1995 | Lewis | 405/53 |
| 5,495,695 | A | | 3/1996 | Eliott, Jr. | |
| 5,555,999 | A | | 9/1996 | Wilcox | |
| 5,564,588 | A | | 10/1996 | Reese | |
| 5,601,204 | A | | 2/1997 | Hall | |
| 5,664,696 | A | | 9/1997 | Canga | |
| 5,884,709 | A | * | 3/1999 | Evans et al. | 220/565 |
| 6,026,975 | A | * | 2/2000 | Slater | 220/565 |
| 6,254,309 | B1 | * | 7/2001 | Northcott et al. | 405/53 |

OTHER PUBLICATIONS

Brochure entitled "Quick Guide for Installation of Oilfield Service Tanks For Single Wall and Double Wall Fiberglass Underground Service Tanks—GREENTANK", ZCL Fiberglass, a division of ZCL Composites Inc., Nov. 1995. 4 pages.

Brochure entitled "Double Wall/Double Composite Tanks", Tankman, a division of ETT Chemicals Inc., undated, 4 pages.

Brochure entitled "Double Wall/Double Composite Tank Installation Procedure", Tankman, a division of ETT Chemicals Inc., undated, 3 pages.

* cited by examiner

SUBTERRANEAN STORAGE VESSEL SYSTEM

CROSS REFERENCE TO RELATED APPLICATION

This is a continuation-in-part of U.S. patent application Ser. No. 09/204,183, filed on Dec. 3, 1998, now U.S. Pat. No. 6,254,309.

FIELD OF INVENTION

A storage vessel system for subterranean installation and a method for constructing the storage vessel system. The system comprises a storage vessel and a support structure for the storage vessel, which support structure permits both downward gravitational forces such as the weight of the storage vessel and upward buoyancy forces applied to the storage vessel due to groundwater or other causes to be transferred to the support structure.

BACKGROUND OF INVENTION

Underground storage vessels are commonly used for the storage of a variety of fluids including water, chemicals and hydrocarbons. In the past, such vessels have been typically comprised of steel. However, steel vessels are relatively heavy, leading to difficulties with the transportation and installation of such vessels and the resulting costs associated with such difficulties. Further steel vessels are subject to corrosion when left in place for a substantial period of time. As a result of the tendency to corrode over the years, regular repair and replacement of these vessels is often required in order to avoid vessel failure and the resulting potential for ground contamination when the vessel contains environmentally hazardous fluids.

As a result of the difficulties associated with underground storage vessels made of steel, many underground storage vessels in use today are comprised of fiberglass. These fiberglass storage vessels may be single walled or double walled where secondary containment is desired for hazardous fluids contained within the vessel. For instance, the majority of underground fiberglass vessels are double walled with a monitor in the interstitial space between the inner and outer walls in order to ensure the integrity of the walls. It has been found that fiberglass is relatively light in weight as compared to steel and that it is corrosion free both internally and externally. Accordingly, fiberglass tends to be well suited for underground installation.

However, fiberglass vessels often present their own difficulties with respect to their use and installation. For instance, fiberglass vessels are relatively delicate in that the material tends to be easily damaged. In particular, fiberglass vessels typically do not tolerate any significant deflection along their length. Where the fiberglass material is damaged, there is a risk of vessel failure, with the resulting environmental hazards and remediation costs, including the cost of replacement or repair of the vessel. More particularly, fiberglass vessels are commonly subjected to material damage during handling and loading of the vessel both prior to and during installation at a new site. Similarly, damage may be caused during the relocation or removal of a vessel from an existing site.

Further, the vessel wall may fail as a result of stresses or forces imposed on the installed vessel due to ground movement or settling of the vessel or due to the effects of buoyancy on the vessel from any ground water at the site. Ground movement or settling, the effects of buoyancy and improper installation may also lead to a failure of the nozzles or fittings associated with the vessel at the point or location of connection of the fittings to the vessel. Finally, current methods for the installation of underground storage vessels, and in particular fiberglass vessels, as discussed further below, tend to be both relatively costly, time consuming and potentially hazardous.

One method of installing underground storage vessels, including fiberglass storage vessels, requires extensive site preparation including the installation of an anchoring system. Specifically, the intended site of the storage vessel is excavated to the necessary dimensions to permit the installation of the vessel and to permit one or more people to work within the excavation. An anchoring system is then installed at the base of the excavation. A typical anchoring system includes concrete holddowns or pile holddowns installed at the base of the site and one or more straps which pass about the vessel and are connected to the holddowns. The vessel is lowered into the site and the anchoring system is manually connected to the vessel. The excavated site is then backfilled to the ground surface. Further, once the installation is completed, the storage vessel is typically tested to ensure the integrity of the underground system.

As the vessel is installed directly into the excavated site, the site must be carefully prepared and compacted, where necessary, prior to the installation of the storage vessel. In addition, the anchoring system must be installed within the site prior to or contemporaneously with the installation of the vessel. Further, if excessive water accumulation is anticipated at the excavated site or the site has a particularly high water table, the water level must be kept as low as possible during installation in order to properly install the vessel. As a result, the use of pumps and ballast tanks may be required for the installation. Finally, the installation of the anchoring system is critical to the reliability or integrity of the vessel. Specifically, small shifts in the position of the anchoring system may lead to shifts in the position of the storage vessel, which may lead to a rupture or failure of the fittings or piping between the vessel and the surface. Typically, such failures occur at the point or location of the connection of the fitting to the vessel.

Once the site is prepared, the vessel is shipped to the site and installed in a relatively unprotected state. As a result, significant damage may occur to the material of the vessel during the shipping and installation procedures. Similarly, in the event that repair of the storage vessel is required, excavation of the unprotected vessel may also result in significant damage of the vessel.

As well, the installation of the anchoring system, the installation of the vessel and the connection of the anchoring system to the vessel are typically labor intensive tasks and typically require one or more people to work within the excavated site. The need for the presence of one or more people within the excavated site presents various excavation requirements in order to provide access to the site and to minimize any resulting safety hazards. For instance, strict safety standards for the excavation must typically be followed, including requirements for a relatively large excavation site and for sloping of the excavated walls. These requirements may increase the cost of the preparation of the site prior to the actual installation of the vessel.

Further, the backfill for the excavated site must be carefully selected given the direct physical contact of the backfill with the storage vessel. This is particularly important when the storage vessel is made of fiberglass. The need for a particular type of backfill may further increase the cost of the installation. As well, the backfill operation must be carefully conducted in order to avoid damage to the vessel and in order to provide proper compaction about the vessel.

A further method of installing underground storage vessels is to provide an underground vault in which the storage vessel is installed. As the vessel is placed within the underground vault, some protection is provided to the vessel following the installation. As well, where environmentally hazardous fluids are contained within the vessel, the vault may provide secondary containment in the event of any leakage. However, this method of installation is also not completely satisfactory.

For instance, the site must still be prepared in advance of the installation of the vessel by either preparing or constructing the vault on-site or assembling pre-fabricated elements of the vault at the site. Alternately, the fully assembled vessel and vault structure may be transported to the site for installation, however, the size and weight of the fully assembled unit may present problems with respect to its transportation to and installation at the site. In addition, in some cases, the vault itself may require the installation of an anchoring system at the site or the attachment of deadweights to ensure the anchoring of the vault structure. Thus, this method of installation and subsequent testing of underground storage vessels continues to be time consuming, labor intensive and presents its own disadvantages and safety hazards which must be addressed.

Further, unless the vault is transported to the site within a fully assembled vault structure, the vessel must still be shipped to the site for installation in a relatively unprotected state. Thus, significant damage may still occur to the material of the vessel during the shipping and installation procedures. Similarly, although the vault provides some measure of protection to the vessel, repair or replacement of the unprotected vessel may result in damage to the vessel, particularly where the vault contains backfill material about the vessel.

One example of a vault which is prepared on-site is provided by U.S. Pat. No. 4,934,866 issued Jun. 19, 1990 to Gage. Gage describes an underground fiberglass vault into which one or more underground storage vessels are secured. To install the vault, a pit is excavated and a concrete base is poured in the bottom of the pit. The sides of the pit are lined with sheetrock panels and a liquefied fiberglass mixture is sprayed onto the panels and the concrete slab. One or more underground storage vessels are then placed within the vault, secured to the floor by conventional anchors and cables and connected to conventional supply lines. The anchors may be placed in the concrete base prior to its hardening or may be placed in a base layer of pea gravel contained within the vault. Once the vessels are anchored, the remainder of the vault is backfilled with further pea gravel.

One example of a vault which is pre-fabricated and assembled on-site is provided by U.S. Pat. No. 4,961,293 issued Oct. 9, 1990 to House et. al. This patent describes a precast, prestressed concrete secondary containment vault comprised of a number of units including a bottom unit, a top unit and a collar or side unit. Each unit is comprised of one or more concrete panels which interlock to form the various units of vault. Cradles for supporting the storage vessels are contained within the bottom unit. To install the vault, the construction location is first excavated and a sand bed is graded. The bottom unit is then lowered into the excavation pit and leveled. The cradles are pinned to the inner face of the bottom unit. The collar unit is then lowered onto the bottom unit and the storage vessel is installed therein. Finally, the top unit is lowered into place and the excavation pit is backfilled.

Further, U.S. Pat. No. 5,037,239 issued Aug. 6, 1991 to Olsen et. al. describes a vault structure designed so that all of the panels used in its construction may be precast at a remote site and transported to the construction site for assembly. The construction site is excavated and prepared for the structure. The floor panels are then lowered into the excavation and assembled, followed by positioning of the walls, storage vessels and roof. The storage vessels are supported on the floor by cradles. More particularly, the vault is comprised of three precast concrete floor panels, three precast concrete roof panels and four precast concrete wall panels. The size and number of panels is limited by the allowable size and weight of panel that can be transported to the construction site.

U.S. Pat. No. 5,664,696 issued Sep. 9, 1997 to Canga describes a two stage construction of an underground vault. The first stage is a lower stage which includes a floor and part of the sides extending up to a level approximately that of the height of the storage vessel. The second stage is an upper stage which rests on the lower stage and which supports the lid of the vault. Once the lower stage is lowered into place in the excavation, a bed of filler material is poured into the lower stage. The storage vessel is placed within the lower stage on the bed of filler material. Once the piping to the surface is connected, further filler material is added and the upper stage is lowered into position. The lid is then placed on the upper stage. The walls of the vault have means for coupling slings for hoisting and lowering the vault. These coupling means may also be used for attaching deadweights after installation, in place of a more conventional anchoring system. The deadweights are required to stabilize the vault underground and to avoid flotation which may endanger the vault structure and the fittings or piping.

Further examples of pre-cast or pre-fabricated vaults are provided by U.S. Pat. No. 5,391,019 issued Feb. 21, 1995 to Morgan and U.S. Pat. No. 5,495,695 issued Mar. 5, 1996 to Elliot, Jr.

The prior art systems referred to above are all relatively complicated in design and are all intended to provide supplementary containment for the contents of a conventional storage vessel. In addition, these prior art systems tend to be relatively difficult to install and uninstall and are not typically intended to protect the storage vessel during their transportation, installation or removal.

There remains a need for a storage vessel system for subterranean installation which will protect and support a conventional storage vessel and which is not required to supplement the containment properties of a conventional storage vessel.

There is a need for such a storage vessel system which may be transported to, installed at and removed from a construction site as an integral unit.

There is a need for such a storage vessel system which provides support for a conventional storage vessel with respect to downward gravitational forces such as the weight of the storage vessel and which anchors the storage vessel against any upward buoyancy forces which may be applied to the storage vessel by groundwater or other causes.

There is a need for such a storage vessel system which provides protection and support for a conventional storage vessel during transportation, subterranean installation and removal of the storage vessel system.

Finally, there is a need for a storage vessel system which provides support for fittings associated with the storage vessel in order to reduce the likelihood of damage to the storage vessel in the vicinity of the fittings.

SUMMARY OF INVENTION

The present invention is directed at a storage vessel system for subterranean installation and to a method for constructing the storage vessel system. The system comprises a storage vessel and a support structure for the storage vessel. The support structure supports the storage vessel with respect to downward gravitational forces such as the weight of the storage vessel and anchors the storage vessel against any upward buoyancy forces applied to the storage vessel due to groundwater or other causes.

The system preferably provides protection to the storage vessel and preferably aids in the installation of the storage vessel. The system preferably also provides support for the fittings located on the storage vessel, particularly at the location of the connection of the fitting to the storage vessel.

The support structure is designed to be permeable to fluids so that the support structure does not perform a containment function to supplement the containment provided by the storage vessel. The permeable support structure renders the storage vessel system more simple to construct in comparison with prior art systems that do provide supplementary containment for a storage vessel. The permeable support structure also makes it possible for the storage vessel system to be constructed to be more lightweight than prior art systems, since a buoyancy force due to groundwater or other causes will not act on the entire volume of the support structure, as would be the case if the support structure was sealed and thus provided a supplemental containment function.

In a first aspect of the invention, the invention is a storage vessel system for subterranean installation in ground, the system comprising:

(a) a storage vessel having a weight;

(b) a support structure connected with the storage vessel, wherein the support structure defines a vessel housing, wherein the storage vessel is contained within the vessel housing, and wherein the support structure is comprised of:

(i) a bearing surface adapted for contacting the ground such that the system is supported on the ground;

(ii) a vessel anchor for anchoring the storage vessel against an upward buoyancy force exerted on the storage vessel when an infiltrating fluid at least partly submerges the storage vessel, such that the upward buoyancy force is transferred to the support structure;

(iii) a permeable exterior shell which permits the infiltrating fluid to infiltrate the vessel housing such that the upward buoyancy force is exerted on the storage vessel; and (iv) a packing material contained within the vessel housing by the exterior shell, the packing material substantially surrounding the storage vessel in order to protect the storage vessel and in order to support the storage vessel such that the weight of the storage vessel is transferred to the support structure.

In a second aspect of the invention, the invention is a method for constructing a storage vessel system comprising a storage vessel and a support structure, the method comprising:

(a) providing a floor shell section;

(b) connecting at least one sidewall level of a sidewall shell section to the floor shell section;

(c) connecting at least one pair of lifting columns to the sidewall shell section;

(d) connecting a vessel anchor to each of the pair of lifting columns, wherein the vessel anchor is comprised of a holddown strap;

(e) placing the storage vessel within the sidewall shell section is spaced relation to the floor shell section;

(f) connecting the holddown strap to the storage vessel so that the storage vessel is anchored by the pair of lifting columns;

(g) placing a lower layer of a foundation packing material within the sidewall shell section and between the floor shell section and the storage vessel so that the lower layer of foundation packing material partially surrounds and supports the storage vessel;

(h) completing the sidewall shell section so that the sidewall shell section is comprised of a plurality of sidewall levels and to provide an exterior shell comprising the floor shell section and the sidewall shell section;

(i) connecting the pair of lifting columns with a lifting beam at a pair of connection locations adjacent to an upper end of each of the lifting columns; and (j) substantially filling the exterior shell with a particulate material in order to protect the storage vessel and to provide the support structure, the support structure defining a vessel housing and comprising the holddown strap, the exterior shell, the pair of lifting columns, the lifting beam, the lower layer of foundation packing material and the particulate material.

The storage vessel system may be submerged in any enveloping medium. However, in the preferred embodiment, the system provides a subterranean (i.e., underground) storage vessel system. Preferably the system has a weight sufficient to overcome the upward buoyancy force when the system is submerged and the storage vessel is empty so that the use of external anchoring devices can be avoided.

The storage vessel may be comprised of any material which is compatible with the medium or material in which the vessel is to be installed or submerged and which is compatible with the fluids or other material to be contained within the vessel.

Accordingly, in the preferred embodiment, the storage vessel may be comprised of any material compatible with its placement or installation in the ground. Thus, the vessel material is preferably resistant to corrosion. In the preferred embodiment, the storage vessel is comprised of fiberglass.

The storage vessel is comprised of an exterior surface which provides an exterior surface area of the storage vessel. The storage vessel defines an interior chamber for storage of fluids therein. Any fluids or other materials, compatible with the material comprising the vessel, may be contained therein. The storage vessel has a weight, which weight may include the weight of the storage vessel itself, the weight of fluid or other material contained within the storage vessel, and the weight of any overburden or other material which is placed on top of the storage vessel.

The storage vessel may provide a single-walled structure or a double-walled structure. However, the storage vessel relies upon the containment properties of the storage vessel, since the support structure is not intended to provide supplemental containment for the storage vessel. As a result, where the fluids or material contained within the vessel are hazardous in nature, a double-walled structure for the storage vessel is preferred in order to provide secondary containment in the event of a failure of the storage vessel.

The storage vessel may have any shape or dimensions compatible with the support structure and with the desired installation of the system. Preferably, the storage vessel has a vessel length, a first vessel end and a second vessel end. In the preferred embodiment, the storage vessel is comprised of an elongated, substantially cylindrical tank.

The storage vessel is preferably further comprised of at least one fitting to facilitate communication with the interior chamber of the storage vessel. Each fitting may act as an inlet, an outlet or both to the storage vessel and may permit the passage of fluids or other material therethrough.

The support structure defines a vessel housing, which vessel housing contains the storage vessel. The support structure is connected with the storage vessel. The support structure has several functions. One function of the support structure is to support the weight of the storage vessel. A second function of the support structure is to anchor the storage vessel against the upward buoyancy force. A third function of the support structure is to protect and cushion the storage vessel from external forces and impacts. A fourth function of the support structure is to isolate the storage vessel from external lifting forces which may be required to lift and move the storage vessel system so that such forces are not applied directly to the storage vessel.

The support structure may have any shape, dimensions and configuration which is compatible with the desired installation of the system, with the vessel, and with the functions of the support structure as described above. The shape, dimensions and configuration of the support structure must also facilitate the definition of the vessel housing such that the storage vessel may be contained therein.

Preferably the various functions of the support structure are performed by the bearing surface, the vessel anchor, the exterior shell, and the packing material, which may be comprised of any elements, components or members connected, welded or otherwise fastened together which are able to support and protect the system and the storage vessel in the manner described above.

The support structure may be comprised of any material which is compatible with the medium or material in which the system is to be installed or submerged. Accordingly, in the preferred embodiment, the support structure may be comprised of any material compatible with its placement or installation in the ground.

The bearing surface contacts the ground in order to support the storage vessel system. In the preferred embodiment, the ground is a ground surface which is comprised of the base of an excavated pit in the earth in which the system is to be installed. However, the ground which is contacted by the bearing surface may be comprised of any surface capable of supporting the system thereon, including for example a prepared subbase, a concrete slab, or a pile foundation.

The vessel anchor is preferably comprised of at least one holddown device associated with the support structure for anchoring the storage vessel to the support structure. The holddown device may be comprised of any components, elements, members or structure able to anchor the storage vessel so that the upward buoyancy force applied to the storage vessel is transferred to the support structure. Preferably, the holddown device is comprised of at least one holddown strap.

In the preferred embodiment, the storage vessel has a first vessel end and a second vessel end and the vessel anchor is comprised of a first holddown strap and a second holddown strap which connect the storage vessel to the support structure between the first vessel end and the second vessel end. The holddown straps may be comprised of any material which is capable of providing the anchoring function. In the preferred embodiment the holddown straps are constructed of galvanized steel.

In general, the number of holddown straps will increase as the size of the storage vessel increases. As a result, the support structure may be comprised of more than two holddown straps. Preferably the holddown straps engage the storage vessel at locations on the storage vessel which are specifically adapted for accepting holddown straps. For example, in the preferred embodiment the holddown straps preferably engage the storage vessel along reinforcing ribs on the storage vessel.

The permeable exterior shell may be comprised of any elements, components, members or structure capable of substantially surrounding the vessel housing and the storage vessel contained therein while permitting the infiltrating fluid to infiltrate the vessel housing. The exterior shell may be comprised of any material which is compatible with the medium or material in which the system is to be installed or submerged.

In the preferred embodiment, the exterior shell is comprised of a material which is compatible with its placement or installation in the ground. In the preferred embodiment, the exterior shell is preferably comprised of galvanized steel so that it resists rusting.

The primary function of the exterior shell is to contain the packing material within the vessel housing so that the storage vessel can be supported and protected by the packing material. In the preferred embodiment, the exterior shell also provides a lifting structure which supports the storage vessel and the packing material during lifting of the storage vessel system.

It is important that the exterior shell be permeable so that the infiltrating fluid may infiltrate the vessel housing. The permeability of the exterior shell may be provided in any manner. As one example, the exterior shell may be constructed of a perforated material. As another example, the exterior shell may be comprised of a plurality of shell members and the permeability of the exterior shell may be provided by permeable (i.e., unsealed) joints between adjacent shell members.

In the preferred embodiment the exterior shell is comprised of a floor shell section and a sidewall shell section. Preferably the bearing surface of the support structure is provided by the floor shell section.

The floor shell section and the sidewall shell section may be integral so that the exterior shell is formed in one piece. Preferably, however, the exterior shell is comprised of a plurality of shell members and the floor shell section and the sidewall shell section are connected together. More preferably the shell members are comprised of a plurality of floor shell members and a plurality of sidewall shell members.

In the preferred embodiment the floor shell section is comprised of a plurality of floor shell members which are connected together. Preferably the floor shell members are substantially parallel to each other.

In the preferred embodiment the sidewall shell section is comprised of a plurality of sidewall shell members which are connected together. Preferably the sidewall shell members are substantially parallel to each other. Preferably the sidewall shell members are horizontally disposed on top of each other so that the sidewall shell section is comprised of a plurality of sidewall levels. The plurality of sidewall levels preferably include an upper sidewall level, a lower sidewall level and a plurality of intermediate sidewall levels.

The shell members may be of any shape which facilitates the connection of shell members with each other. Preferably, however, at least some of the shell members are formed as structural members so that they can add strength and rigidity to the support structure. In the preferred embodiment the shell members are comprised of C-shaped channel members, each of which is comprised of a pair of shell member flanges. Preferably the shell member flanges are oriented so that they protrude into the vessel housing, thus streamlining the exterior of the support structure.

In the preferred embodiment, adjacent shell members are connected together at the shell member flanges so that the exterior shell is comprised of a lifting structure comprised of the floor shell members and the sidewall shell members.

The primary function of the packing material is to protect and cushion the storage vessel from external forces and impacts. The packing material may be comprised of any material which can be contained within the exterior shell and which is compatible with the material comprising the storage vessel. The packing material must also be capable of performing its primary function without causing significant damage to the storage vessel. The packing material may be comprised of any suitable material, including solids (including particulate and non-particulate solids), liquids, gels and foams.

Preferably, a secondary function of the packing material is to provide a vessel support for the storage vessel so that the weight of the storage vessel may be transferred to the support structure. The use of the packing material for the dual purposes of protecting the storage vessel and supporting the storage vessel eliminates the need for the support structure to provide a separate vessel support.

As a result, in the preferred embodiment the packing material is comprised of a lower layer of a foundation packing material for supporting the storage vessel, wherein the lower layer of foundation packing material partially surrounds the storage vessel. Preferably the foundation packing material is a non particulate solid material, a foam or a gel, which can be placed inside the vessel housing in a fluid state so that it can mold to the shape of the vessel housing and the storage vessel and will then subsequently harden to provide a vessel support for the storage vessel.

Preferably the foundation packing material is comprised of a cementitious material which is placed in the vessel housing in a fluid state and then hardens. The cementitious material may be a resin, grout, mortar cement or other suitable material. In the preferred embodiment the cementitious material is comprised of a portland cement product which includes fine aggregate but not coarse aggregate. Preferably the cementitious material is prevented from bonding with the storage vessel by interspersing a layer of plastic or some other material between the storage vessel and the cementitious material before placing the cementitious material in the vessel housing.

In situations where the weight of the storage vessel system must be minimized, the cementitious material is preferably a relatively lightweight material. In the preferred embodiment, the cementitious material is comprised of a lightweight cellular portland cement material.

Preferably the lower layer of the foundation packing material surrounds less than about seventy five percent of the exterior surface area of the storage vessel. More preferably the lower layer of the foundation packing material surrounds less than about fifty percent of the exterior surface area of the storage vessel so that the storage vessel can be removed from the support structure if necessary without first removing all or a portion of the foundation packing material.

The storage vessel is preferably separated from the floor shell section of the exterior shell section by the foundation packing material so that the storage vessel is supported by the lower layer of foundation packing material and not directly by the exterior shell. In the preferred embodiment the storage vessel is separated from the floor shell section by a storage vessel support, which preferably is comprised of two or more vessel support members.

In the preferred embodiment the strength of the cementitious material as a vessel support is enhanced by the presence of the shell member flanges protruding into the vessel housing and the lower layer of cementitious material enhances the strength of the support structure as it cures and bonds to the exterior shell.

The packing material is further comprised of a packing material above the lower layer of foundation packing material so that the storage vessel is substantially surrounded by the packing material. The additional packing material may be any suitable packing material as described above but is preferably comprised of a particulate material.

Preferably, the packing material above the lower layer of foundation packing material is comprised of an aggregate or is comprised of rubber particles. In the preferred embodiment the packing material is comprised of a lower layer of cementitious material to provide a vessel support, an intermediate layer of rubber particles and an upper layer of aggregate. The aggregate may be comprised of pea gravel and the rubber particles may be derived from recycled rubber.

The choice and amounts of particulate packing material will influence the overall weight of the storage vessel system. For example, aggregate tends to be relatively heavy and rubber particles tend to be relatively light. The overall weight of the system in the preferred embodiment can therefore be changed by adjusting the relative amounts of aggregate and rubber particles that are used for the particulate packing material.

Preferably the storage vessel is separated from the top of the vessel housing and preferably the vessel housing is substantially filled by the storage vessel and by the packing material so that the storage vessel is completely surrounded by the packing material.

The storage vessel system as described above may be lifted without applying a lifting force directly to the storage vessel by applying the lifting force directly to the exterior shell. Preferably, however, the support structure is further comprised of at least one pair of lifting columns, wherein each of the lifting columns is connected to the sidewall shell section. The presence of the lifting columns and their connection to the exterior shell facilitates the lifting of the storage vessel system by applying the lifting force to the lifting columns instead of directly to the exterior shell.

In the preferred embodiment the support structure is further comprised of a lifting beam which is connected between the pair of lifting columns at a pair of connection locations adjacent to the upper ends of the lifting columns. The presence of the lifting beam and its connection to the lifting columns facilitates the lifting of the storage vessel system by applying the lifting force directly to the lifting beam. Preferably the lifting beam is provided with one or more lifting lugs to provide points of connection with a crane or other lifting apparatus.

The support structure may be comprised of as few as one pair of lifting columns and one lifting beam. Preferably the support structure is comprised of at least two pairs of lifting columns and at least two lifting beams so that the lifting force can be balanced and distributed along the length of the storage vessel.

In the case of a large storage vessel, the support structure may be comprised of more than two pairs of lifting columns and more than two lifting beams. Preferably, the support structure is comprised of one holddown strap for each pair of lifting columns so that there is one holddown strap for each lifting beam.

As indicated, the exterior shell preferably functions as a lifting structure comprising a plurality of shell members connected together. This feature of the exterior shell eliminates the need for a separate load bearing frame by making use of the structural integrity of the exterior shell to carry lifting forces which are applied to the storage vessel system.

The storage vessel system may be designed so that all lifting forces are transferred from the exterior shell to the lifting columns and then to the lifting beams. Preferably, however, the storage vessel system is designed so that lifting forces are distributed between the exterior shell and the lifting columns so that the strength requirements of both the exterior shell and the lifting columns can be minimized. Preferably, the exterior shell and the lifting columns each transfer their share of the lifting forces directly to the lifting beam.

Preferably the lifting columns are therefore connected with the exterior shell at more than one location so that the lifting columns and the exterior shell can function as an integral lifting structure between the points of connection.

In the preferred embodiment, each of the lifting columns is connected with the sidewall shell section at both the upper sidewall level and at the lower sidewall level. In the preferred embodiment, the lifting columns are connected with the upper sidewall level at the connection locations between the lifting columns and the lifting beams so that the lifting columns, the lifting beams and the sidewall shell section are all connected at the connection locations.

The support structure is preferably further comprised of one or more fitting anchors for connecting the fittings on the storage vessel with the support structure so that a fitting force applied to the fitting is transferred to the support structure.

Any structure capable of transferring the fitting force from the fitting to the support structure may be used as a fitting anchor. Further, the fitting anchor may be associated or connected with any portion, components, elements or members of the support structure. In the preferred embodiment, the fitting anchors are comprised of fitting anchor members which are connected with either the exterior shell or with the lifting beams and the fitting are in turn connected with the fitting anchor members.

The storage vessel system preferably includes a vacuum breaker for use during installation and removal of the storage vessel system. The function of the vacuum breaker is to enable an equalizing fluid to be communicated to the interface between the bearing surface and the ground. In situations where the storage vessel system is being lowered for installation, the vacuum breaker may serve as an outlet for excess pressure at the interface. In situations where the storage vessel is being lifted from removal, the vacuum breaker may serve as an inlet for delivering a fluid pressure to the interface to overcome suction forces at the interface.

Any structure capable of performing the functions of the vacuum breaker may be used. Preferably the vacuum breaker is comprised of at least one vacuum breaker port in the floor shell section and at least one vacuum breaker conduit which has a lower end connected to the vacuum breaker port. Preferably the vacuum breaker conduit extends from the vacuum breaker port so that an upper end of the vacuum breaker conduit is accessible from a location which is exterior of the vessel housing. In the preferred embodiment the vacuum breaker conduit passes through the vessel housing and extends above the upper end of the vessel housing so that it is easily accessible.

BRIEF DESCRIPTION OF DRAWINGS

Embodiments of the invention will now be described with reference to the accompanying drawings, in which.

DETAILED DESCRIPTION

Figure 1:
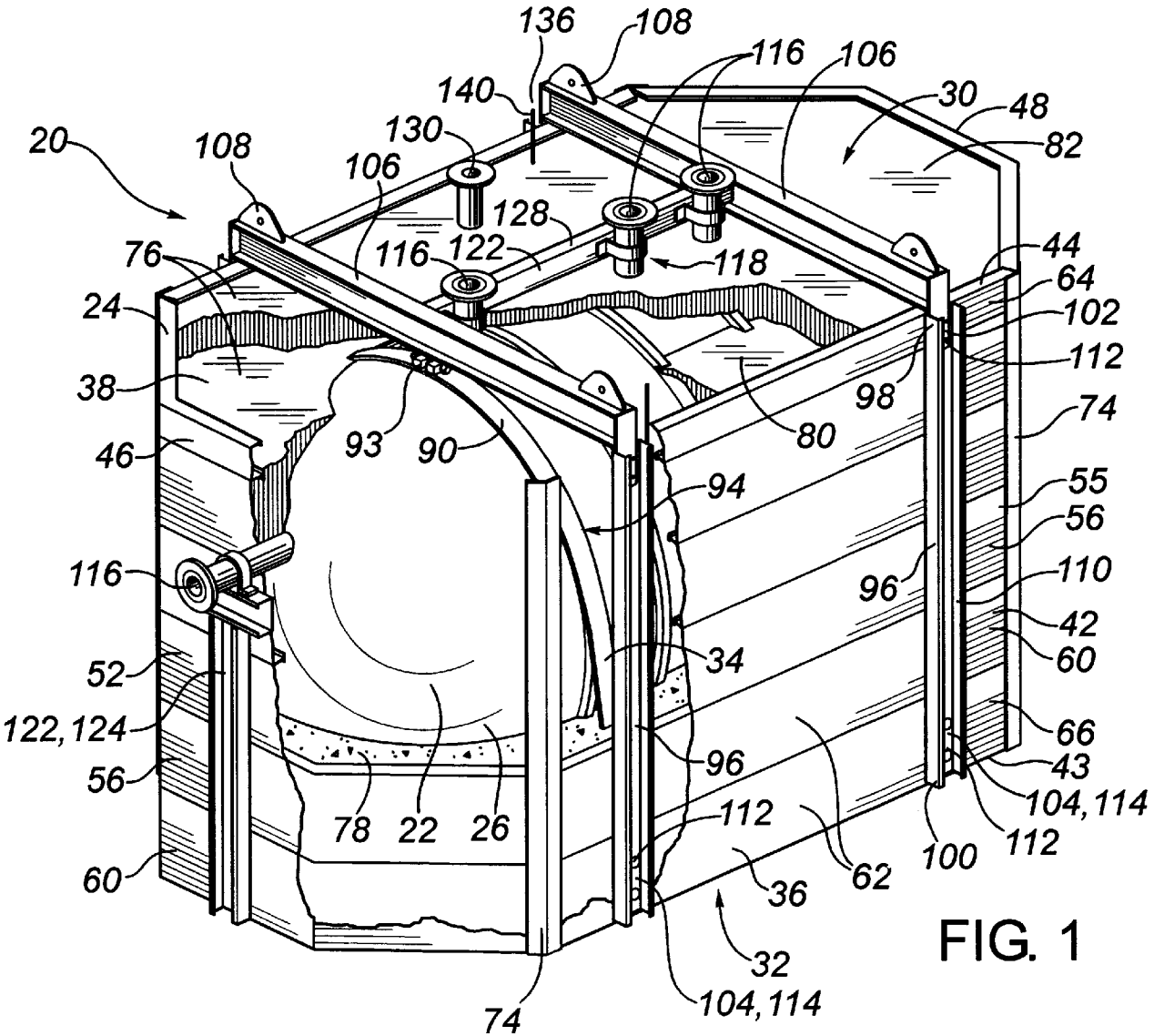
FIG. 1 is a pictorial view of a preferred embodiment of a subterranean storage vessel system comprising a storage vessel and a support structure, wherein an exterior shell and a packing material comprising the support structure have a cut away portion to show the storage vessel therein.

Referring to FIG. 1, the present invention is directed at a storage vessel system (20) for subterranean installation in ground comprised of a storage vessel (22) and a support structure (24) for the storage vessel (22). Further, the invention relates to a method for constructing the storage vessel system (20) comprising the storage vessel (22) and the support structure (24). The system (20) is preferably assembled into or constructed as an integral unit before installation, thus potentially reducing installation time and costs in comparison with the installation of other subterranean storage vessels not including the support structure.

Further, the support structure (24) supports the storage vessel (22) so that downward gravitational forces, such as the weight of the storage vessel (22), and upward buoyancy forces, due to infiltrating fluids or enveloping media such as groundwater, are transferred to the support structure (24).

The downward gravitational forces will typically arise due to the weight of the storage vessel (22) and its contents, as well as the weight of any overburden when installed in ground. The upward buoyancy forces will typically arise due to the storage vessel (22) being submerged in situations where it is fully or partially empty or is filled with material which has a lower density than the medium in which it is submerged. More particularly, the storage vessel system (20) is designed to permit fluids, such as groundwater, to infiltrate the support structure (24) such that the infiltrating fluid at least partly submerges the storage vessel (22) and exerts an upward buoyancy force on the storage vessel (22).

The support structure (24) therefore serves to protect the storage vessel (22) from stress and resulting damage which may be caused by downward gravitational forces or upward buoyancy forces acting on the storage vessel (22). These forces may typically act on the storage vessel (22) during installation of the storage vessel (22) in or removal of the storage vessel (22) from a subterranean environment or during the service life of the storage vessel (22) while it is installed in ground. By transferring the forces to the support structure (24), the forces may be controlled so as to prevent the storage vessel (22) from experiencing stresses that could damage the storage vessel (22).

In this specification, "subterranean" means below the ground surface or below the surface of the earth. In the preferred embodiment, the storage vessel system (20) is intended for subterranean installation. Further, the system (20) is particularly intended for use in circumstances where the system (20) may also be submerged or partly submerged by an infiltrating fluid, such as groundwater. In this specification, "submerged" is defined as "to put or sink below the surface of water or any other enveloping fluid or medium." In other words, the preferred embodiment is intended for used in circumstances where the groundwater table may either temporarily or permanently extend above the lowest portion of the installed storage vessel (22), thus creating the upward buoyancy force exerted on the storage vessel (22).

As indicated, the system (20) is comprised of a storage vessel (22) having a weight. The storage vessel (22) has an exterior surface area (26) and an interior chamber (28). The storage vessel (22) may be any shape or size, and may be fabricated of virtually any type of material, including fiberglass, plastic, metal and composite materials. Preferably, the storage vessel (22) is constructed of a corrosion resistant material. Although any corrosion resistant material may be used, the corrosion resistant material is preferably comprised of fiberglass.

Further, the storage vessel (22) may be of single wall construction or it may provide secondary containment either through double wall construction of through some other secondary containment mechanism. In summary, any subterranean storage vessel may be used in the invention as the storage vessel (22), including conventional storage vessels of the type typically used in underground applications. Most preferably, the storage vessel (22) is cylindrical in shape and is installed horizontally.

In the preferred embodiment, the storage vessel (22) is a single wall or double wall fiberglass underground storage tank or vessel having a capacity of between about 25 barrels and about 200 barrels. One example of a preferred storage vessel (22) for use in the invention is a fiberglass storage vessel manufactured by ZCL Composites Inc. of Edmonton, Alberta, Canada and sold under the trade-mark "Greentank". A second example of a preferred storage vessel (22) for use in the invention is a fiberglass storage vessel manufactured by Triple M Fiberglass Mfg. Ltd. of Edmonton, Alberta, Canada.

In the preferred embodiment, the support structure (24) is connected with the storage vessel (22), wherein the support structure (24) defines a vessel housing (30) and wherein the storage vessel (22) is contained within the vessel housing (30). As a result, the support structure (24) preferably performs a number of functions. First, the support structure (24) protects the storage vessel (22) during transportation, installation and while in service. As a result of this protection, the storage vessel (22) can in some cases be installed more shallow in comparison with conventional installations. Second, the support structure (24) simplifies the installation procedure for the storage vessel (22). Third, the support structure (24) performs an anchoring function which inhibits the storage vessel (22) from upward movement in response to upward buoyancy forces which may be applied to the storage vessel (22) by infiltrating fluids. In the preferred embodiment, these functions are achieved by the specific features of the support structure (24).

Figure 4:
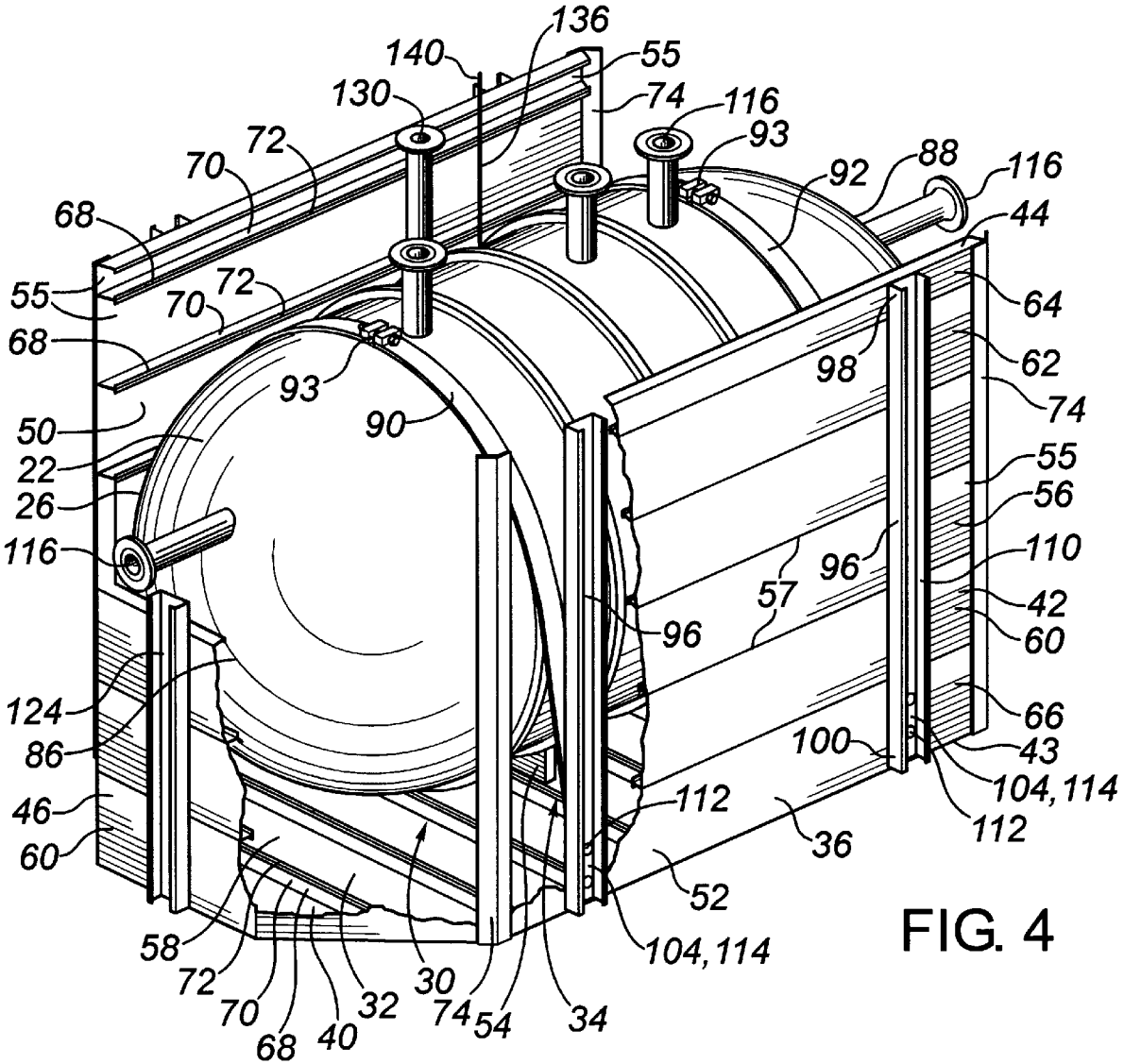
FIG. 4 is a further pictorial view of the preferred embodiment of the subterranean storage vessel system shown in FIG. 3, wherein the lower layer of cementitious material has been removed therefrom.
Figure 5:
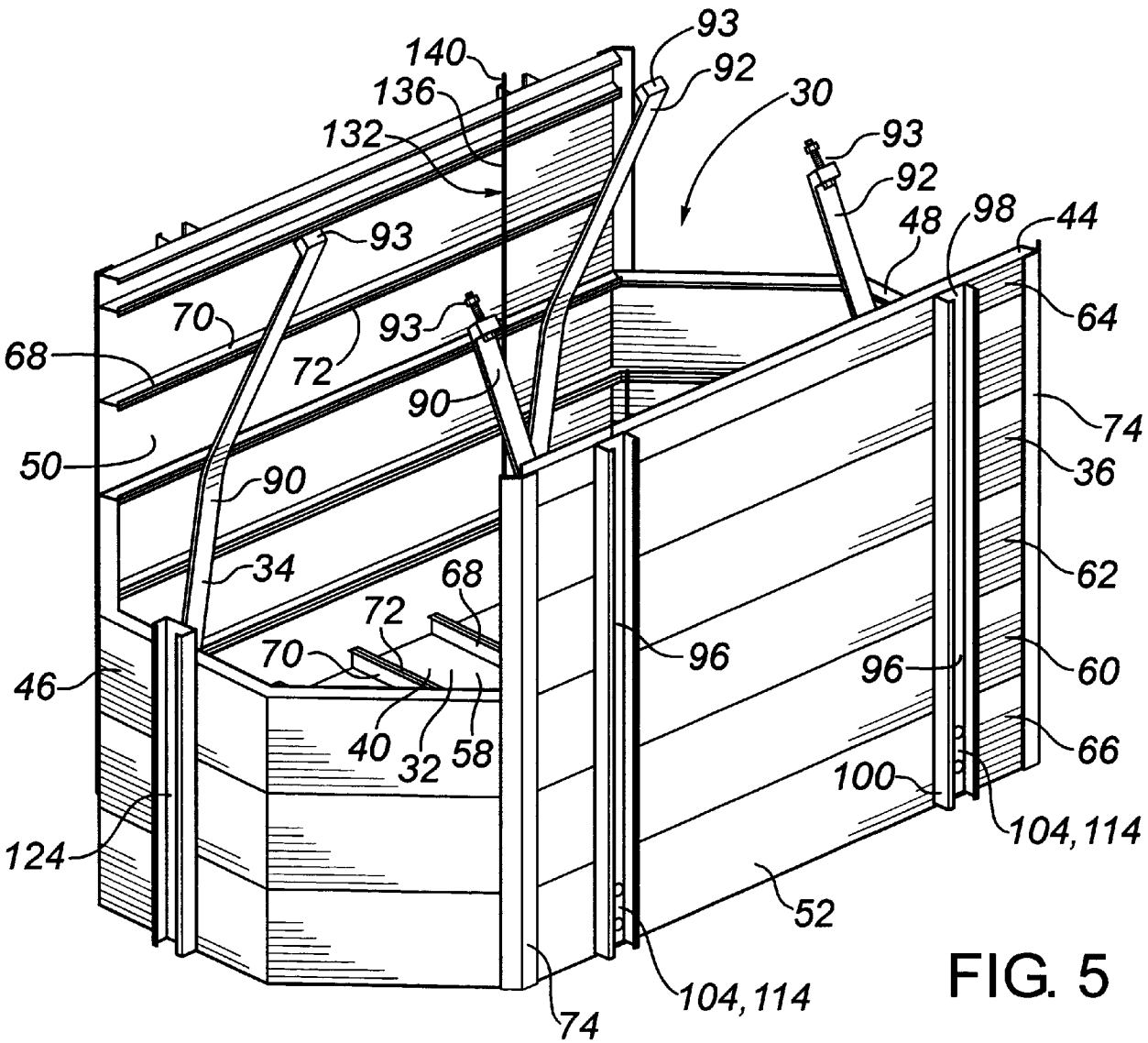
FIG. 5 is a further pictorial view of the preferred embodiment of the subterranean storage vessel system shown in FIG. 4, wherein the storage vessel has been removed therefrom to show a vessel anchor comprising the support structure.
Figure 6:
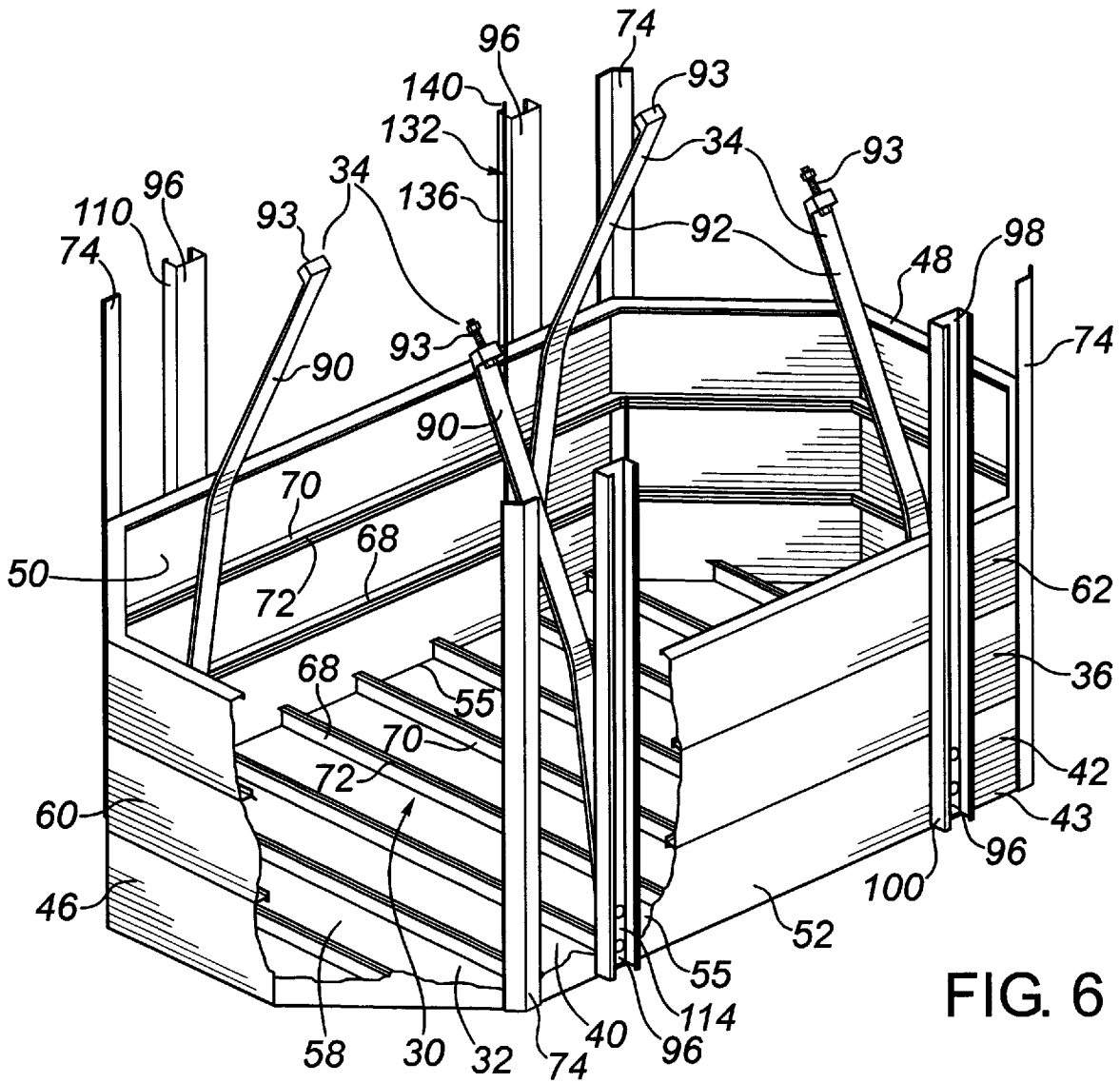
FIG. 6 is a further pictorial view of the preferred embodiment of the subterranean storage vessel system shown in FIG. 5, wherein the exterior shell has a cut-away portion to further show the vessel anchor therein.
Figure 7:
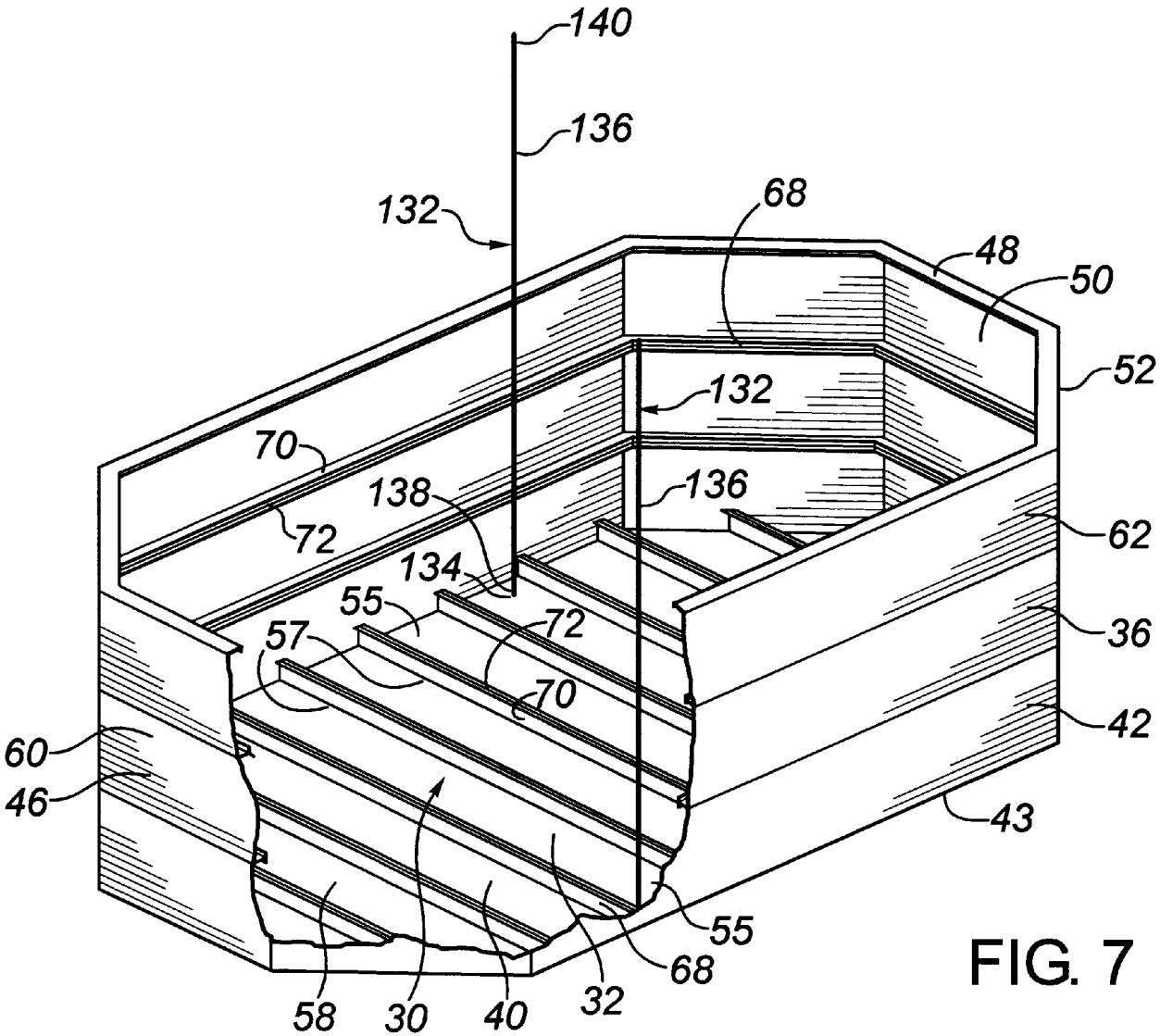
FIG. 7 is a further pictorial view of the preferred embodiment of the submersible storage vessel system shown in FIG. 6, showing a vacuum breaker associated with the exterior shell.

Referring to FIGS. 1 through 7, the support structure (24) includes a bearing surface (32), a vessel anchor (34), a permeable exterior shell (36) and a packing material (38). Referring to FIGS. 6 and 7, the bearing surface (32) is adapted for contacting the ground such that the system (20) is supported on the ground. Thus, the bearing surface (32) provides support for the support structure (24) and thus the entire system (20) on a ground surface on which the system (20) may be placed. In this specification, "ground surface" includes undisturbed soil, backfill, concrete, sand, gravel or any other material upon which the system (20) may be placed.

The bearing surface (32) may be comprised of any structural element, unit or member suitable for contacting the ground and supporting the system (20) thereon. Further, the bearing surface (32) may be comprised of a single element, unit or member adapted for contacting the ground and supporting the system (20) or the bearing surface (32) may be comprised of two or more elements, units or members permanently or detachably connected, affixed or fastened together to form a unitary structure. Further, depending upon the construction of the bearing surface (32), the bearing surface (32) may or may not be permeable to fluids such that an infiltrating fluid may pass through the bearing surface (32) to infiltrate the vessel housing (30). In the preferred embodiment, as described further below, the bearing surface (32) is permeable to fluids.

Further, the bearing surface (32) may be constructed independently or distinctly from the exterior shell (36). In this case, the bearing surface (32) is preferably permanently or detachably connected, fastened, attached or otherwise associated with the exterior shell (36) to form the support structure (24) and define the vessel housing (30). However, in the preferred embodiment, as described in detail below, the bearing surface (32) is comprised of the exterior shell (36). Thus, in the preferred embodiment, the exterior shell (36) including the bearing surface (32) is permeable to permit an infiltrating fluid to pass through or penetrate the exterior shell (36) to infiltrate the vessel housing (30) such that an upward buoyancy force is exerted on the storage vessel (22) contained within the vessel housing (30).

Referring to FIGS. 1–7, as indicated, the support structure (24) is comprised of a permeable exterior shell (36) which permits the infiltrating fluid to infiltrate the vessel housing (30). The exterior shell (36) does not provide, and is not intended to provide, a secondary containment function in the event of a leak in the storage vessel (22). Rather, the exterior shell (36) preferably substantially surrounds the storage vessel (22) to define the vessel housing (30) and to provide protection for the storage vessel (22) contained therein during transportation, installation and while in service. Further, the exterior shell (36) contains the packing material (38) within the vessel housing (30). Finally, preferably, the weight of the storage vessel (22) is transferred to the support structure (24) including the exterior shell (36). In the preferred embodiment, at least a portion of the weight of the storage vessel (22) is transferred to the exterior shell (36).

Referring to FIGS. 4–7, the exterior shell (36) is preferably comprised of a floor shell section (40) and a sidewall shell section (42) connected, fastened or otherwise attached with the floor shell section (40). More particularly, the sidewall shell section (42) extends from a lower edge (43) connected with the floor shell section (40) upwardly to an upper edge (44). The upper edge (44) of the sidewall shell section (42) defines an opening in the exterior shell (36) for access to the storage vessel (22). As discussed previously, in the preferred embodiment, the bearing surface (32) is comprised of the exterior shell (36). Specifically, the bearing surface (32) is preferably comprised of the floor shell section (40) of the exterior shell (36).

Figure 2:
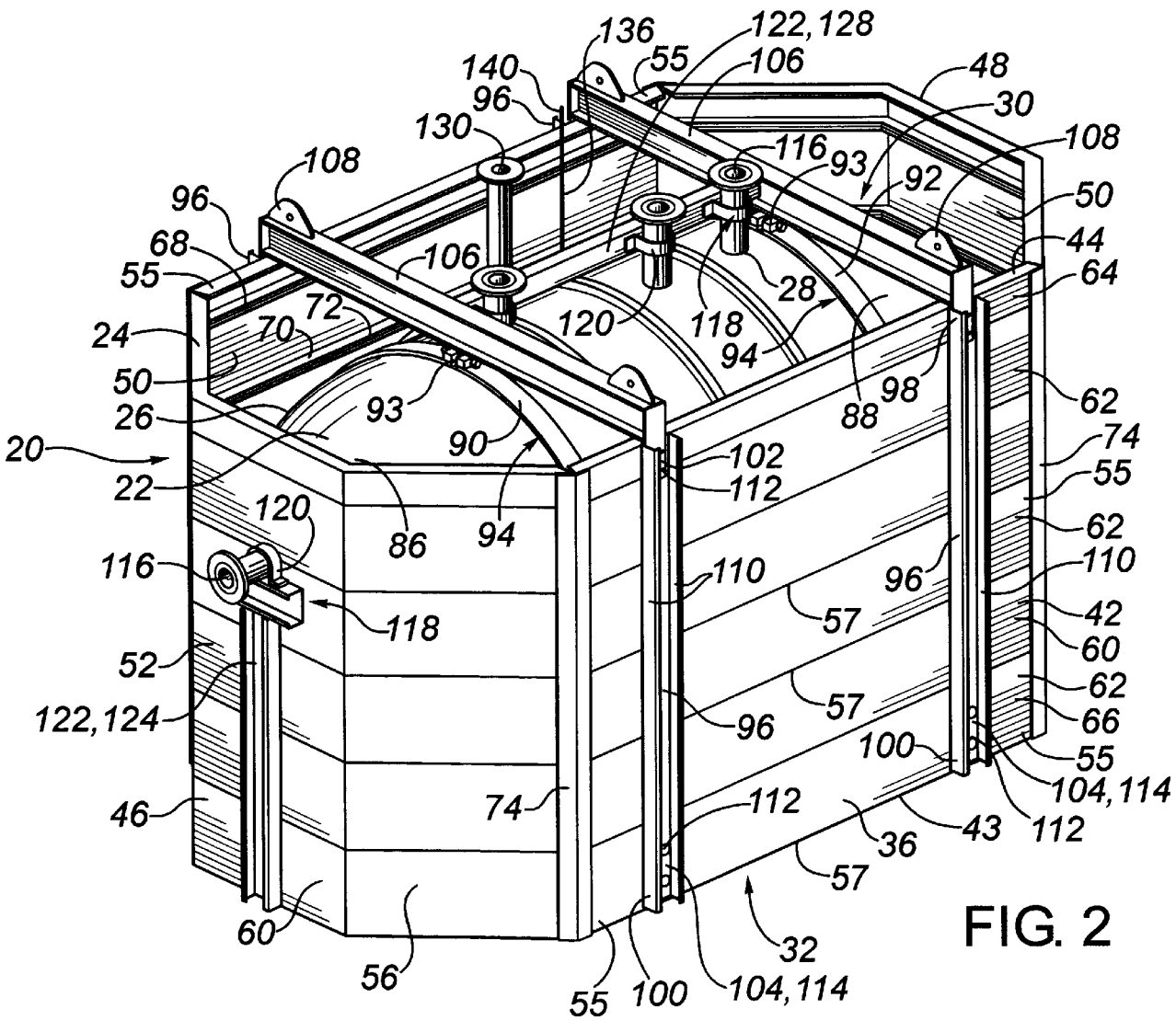
FIG. 2 is a further pictorial view of the preferred embodiment of the subterranean storage vessel system shown in FIG. 1, wherein a particulate material comprising the packing material has been removed therefrom.

Referring to FIGS. 1 and 2, in the preferred embodiment, the exterior shell (36) also has a first shell end (46), a second shell end (48), an interior surface (50) and an exterior surface (52). The storage vessel (22) is positioned within the exterior shell (36) between the first and second shell ends (46, 48) in order to provide an amount of protection to the storage vessel (22). Further, the storage vessel (22) is positioned within the exterior shell (36) such that a spaced distance is provided between the exterior surface area (26) of the storage vessel (22) and the interior surface (50) of both the floor shell section (40) and the sidewall shell section (42) of the exterior shell (36). The spaced distance is provided so that the packing material (38) may be inserted and contained between the adjacent surfaces (26, 50) of the storage vessel (22) and exterior shell (36). The packing material (38) thus further protects the storage vessel (22) and supports the storage vessel (22) such that the weight of the storage vessel (22) may be transferred to the support structure (24).

Thus, the exterior shell (36) may have any size, shape or configuration permitting the containment of the storage vessel (22) and the packing material (38) therein and providing the desired spaced distance between the exterior surface area (26) of the storage vessel (22) and the adjacent interior surface (50) of the floor and sidewall shell sections (40, 42). However, in order to minimize the overall weight of the system (20), the size, shape and configuration of the exterior shell (36) are also preferably selected to be compatible with the size, shape and configuration of the storage vessel (22). In other words, the exterior shell (36) is preferably as small as possible, or is selected to relatively closely fit the storage vessel (22), while still providing the required spaced distance and permitting the exterior shell (36) to function as described herein.

The spaced distance between the exterior surface area (26) of the storage vessel (22) and the adjacent interior surface (5) of the floor and sidewall shell sections (40, 42) may be provided during construction of the system (20) in any manner and by any mechanism resulting in the presence of the spaced distance in the constructed system (20). Preferably, a support mechanism or one or more support members are provided for supporting the storage vessel (22) in the desired position during placement of the packing material (38) within the exterior shell (36). Following placement of the packing material (38), the packing material (38) preferably acts to support the storage vessel (22) in the desired position within the exterior shell (36). Thus, the support mechanism or support members may be removed, where desired, following placement of the packing material (38). However, in the preferred embodiment, the support mechanism or support members are not removed.

More particularly, in the preferred embodiment, the storage vessel (22) is initially supported in the desired position within the exterior shell (36) by a storage vessel support, which is preferably comprised of two or more vessel support members (54), preferably comprised of wood. Specifically, the vessel support members (54) are positioned between the interior surface (50) of the floor shell section (40) and the adjacent exterior surface area (26) of the storage vessel (22) such that the storage vessel (22) initially rests upon and is supported by the vessel support members (54). Following placement of the packing material (38) within the exterior shell (36), the packing material (38) further supports the storage vessel (22) while the vessel support members (54) may act to reinforce the packing material (38) as discussed further below.

The exterior shell (36) may be fabricated from any material and in any manner capable of providing the desired permeability of the exterior shell (36) and capable of performing the other desired functions of the exterior shell (36) as discussed above, without significant deterioration following installation of the system (20). In the preferred embodiment, the exterior shell (36) is fabricated from corrosion resistant steel, preferably galvanized sheet metal.

Further, the exterior shell (36), including each of the floor shell section (40) and the sidewall shell section (42), may be comprised of a single member, element or unit or may be comprised of greater than one member, element or unit connected, fastened or otherwise attached together to form the exterior shell (36). In this case, the adjoining or adjacent members, elements or units may be connected, fastened or attached together in any manner and by any mechanism, permanently or detachably, such as by welding, screws, bolts, other fasteners or interconnecting or interlocking edges. However, in the preferred embodiment, the weight of the storage vessel (22) is transferred to the support structure (24) including the exterior shell (36). Therefore, the mechanism or manner of connection is preferably selected to have sufficient strength to permit the necessary transfer of at least a portion of the weight of the storage vessel (22) or other load upon the storage vessel system (20) to the exterior shell (36). Further, the mechanism or manner of connection is preferably selected to provide for the permeability of the exterior shell (36).

Preferably, the exterior shell (36) is comprised of a plurality of shell members (56) connected, fastened or otherwise attached together in a manner to provide the permeable exterior shell (36). Each shell member (56) is preferably rectangular in shape and defines a longitudinal axis extending therethrough. Further, each shell member (56) has two opposed ends (55) and two opposed longitudinal sides (57) extending between the ends (55) substantially parallel to the longitudinal axis of the shell member (36).

Further, in the preferred embodiment, the shell members (56) are comprised of a plurality of floor shell members (58) and a plurality of sidewall shell members (60). Specifically, the adjacent ends (55) and longitudinal sides (57) of the plurality of floor shell members are connected, fastened or otherwise attached together to provide the floor shell section (40), while the adjacent ends (55) and longitudinal sides (57) of the plurality of sidewall shell members (60) are connected, fastened or otherwise attached together to provide the sidewall shell section (42).

The shell members (56) comprising the exterior shell (36) may be comprised of any material capable of performing the desired functions of the exterior shell (36) as discussed above. In the preferred embodiment, the shell members (56) are comprised of galvanized steel.

Further, although the configuration and the mechanism or method of connection of the floor shell members (58) may differ from that of the sidewall shell members (60), preferably the configuration and the mechanism or method of connection of the floor shell members (58) is similar to that of the sidewall shell members (60). Further, the specific configuration and mechanism or method of connection provide for the permeability of the exterior shell (36) by permitting the infiltrating fluid to pass through the exterior shell (36) between the shell members (56) and thus infiltrate the vessel housing (30).

The floor shell members (58) are preferably arranged or disposed substantially parallel to each other so that the longitudinal axes of the floor shell members (58) are substantially parallel and so that adjacent longitudinal sides (57) of the floor shell members (58) may be connected together. Further, in the preferred embodiment, as shown in FIG. 7, each floor shell member (58) extends across the floor shell section (40) for connection with the lower edge (43) of the sidewall shell section (42). In other words, both ends (55) of each floor shell member (58) are connected with the lower edge (43) of the sidewall shell section (42). However, where necessary, two or more floor shell members (58) may be connected at their adjacent ends (55) in order to extend across the floor shell section (40). In this case, the adjacent ends (55) may be attached, fastened or connected in any manner providing a floor shell section (40) having sufficient strength to support the storage vessel (22) and the packing material (38).

In addition, the floor shell members (58) may be arranged or disposed such that the longitudinal axes of the adjacent floor shell members (58) extend across the floor shell section (40) in any desired direction. For instance, the floor shell members (58) may extend longitudinally between the first shell end (46) and the second shell end (48) such that the longitudinal axes of the floor shell members (58) are substantially perpendicular to the first and second shell ends (46, 48).

However, in the preferred embodiment as shown in FIG. 7, the longitudinal axes of the floor shell members (58) are substantially parallel to the first and second shell ends (46, 48). Any number of floor shell members (58) may be disposed or arranged beside each other for connection at their adjacent longitudinal sides (57) to form the floor shell section (40) depending upon the width of the floor shell members (58) and the size and configuration of the exterior shell (36).

Similarly, the sidewall shell members (60) are also preferably arranged or disposed substantially parallel to each other so that the longitudinal axes of the sidewall shell members (60) are substantially parallel and so that adjacent longitudinal sides (57) of the sidewall shell members (60) may be connected together. In addition, the sidewall shell members (60) may be arranged or disposed such that the longitudinal axes of the adjacent sidewall shell members (60) extend across the sidewall shell section (42) in any desired direction. For instance, the sidewall shell members (60) may extend substantially vertically such that the longitudinal axes of the sidewall shell members (60) are substantially perpendicular to the lower edge (43) of the sidewall shell section (42).

However, in the preferred embodiment as shown in FIGS. 1–7, the sidewall shell members (60) are arranged or disposed substantially horizontally such that the longitudinal axes of the sidewall shell members (60) are substantially parallel to the lower edge (43) of the sidewall shell section (42). Further, the sidewall shell members (60) are horizontally disposed on top of each other so that the sidewall shell section (42) is comprised of a plurality of sidewall levels (62). In the preferred embodiment, the plurality of sidewall levels (62) is comprised of an upper sidewall level (64) and a lower sidewall level (66). Any number of sidewall levels (62) may be disposed between the upper and lower sidewall levels (64, 66) to form the sidewall shell section (42) depending upon the width of the sidewall shell members (60) and the sizes and configuration of the exterior shell (36).

Further, each sidewall level (62) is comprised of one or more sidewall shell members (56) connected end (55) to end (55) in order to extend about and defines and sidewall shell section (42). In the preferred embodiment, as shown in FIGS. 1–7, each sidewall level (62) is comprised of a plurality of sidewall shell members (60) connected at their adjacent ends (55) in order to extend about the entire perimeter of the sidewall shell section (42). The adjacent ends (55) may be attached, fastened or connected in any manner providing sufficient strength to maintain the integrity of the sidewall shell section (42) during use of the system (20).

Further, the sidewall shell section (42) may have any shape or configuration on cross-section depending, at least in part, upon the shape and configuration of the storage vessel (22) positioned therein. For instance, the sidewall shell section (42) may be rectangular on cross-section. However, in the preferred embodiment, in order to move closely fit the storage vessel (22), the sidewall shell section (42), and thus each sidewall level (62), has eight sides on cross-section which are shaped and size to be compatible with the storage vessel (22). Thus, in the preferred embodiment, each sidewall level (62) is comprised of eight sidewall shell members (60) connected at their adjacent ends (55).

Referring to FIGS. 4–7, in the preferred embodiment, each shell member (56), including each of the floor shell members (58) and the sidewall shell members (60), is comprised of a pair of shell member flanges (68). The pair of shell member flanges (68) extend along the opposed longitudinal sides (57) of the shell member (56) for at least a portion of the length of the shell member (56) between its ends (55). In the preferred embodiment, the pair of shell member flanges (68) extend substantially along the entire length of the opposed longitudinal sides (57) of the shell member (56) between the ends (55). As described further below, in the preferred embodiment, the shell members (56) are connected at the sheet member flanges (68) so that the exterior shell (36) is comprised of a lifting structure.

Further, although the shell member flanges (68) may protrude into or out of the vessel housing (30), the shell member flanges (68) preferably protrude into the vessel housing (30). Specifically, the protrusion of the shell member flanges (68) within the vessel housing (30) may serve to reinforce the packing material (38) contained within the vessel housing (30) by the exterior shell (36).

As stated, in the preferred embodiments, the shell members (56) are connected at the shell member flanges (68) so that the exterior shell (36) is comprised of a lifting structure. In other words, the adjacent shell members flanges (68) of adjacent shell members (56) are connected in a manner to provide a lifting structure which supports the storage vessel (22) and the packing material (38) during lifting of the storage vessel system (20). The shell member flanges (68) may have any shape or configuration permitting this connection of adjacent flanges (68).

However, referring to FIG. 7, preferably, each shell member flange (68) has a first leg portion (70) and a second toe portion (72). The first leg portion (70) preferably extends perpendicularly from the planar surface of the shell member (56), while the second toe portion (72) preferably extends perpendicularly from the first leg portion (70) in an inward direction towards the center of the shell member (56). In the preferred embodiment, the first leg portions (70) of the adjacent shell member flanges (68) are attached, fastened or otherwise connected together.

Specifically, in the preferred embodiment, in order to form or construct the floor shell section (40), the adjacent longitudinal sides (57) of the floor shell members (58) are connected together by connecting the adjacent first leg portions (70) of the shell member flanges (68) using a plurality of fasteners.

Further, in order to form or construct the sidewall shell section (42), the sidewall shell members (60) comprising each sidewall level (62) are connected at their adjacent ends (55). Specifically, in the preferred embodiment, when positioned end (55) to end (55), an angle if formed between adjacent sidewall shell members (60). As a result, the first leg portions (70) of the adjacent shell member flanges (68) are permitted to overlap upon the removal of the second toe portion (72) of the flange (68) in the area of the overlap. The overlapping surfaces of the first leg portions (70) are then connected together using fasteners to hold the sidewall shell members (58) end to end.

As well, the sidewall levels (62) are disposed horizontally on top of each other and connected together. Specifically, in the preferred embodiment, the adjacent longitudinal sides (57) of the sidewall shell members (60) are connected together by connecting the adjacent first leg portions (70) of the shell member flanges (68) using a plurality of fasteners.

Further, the lower edge (43) of the sidewall shell section (42) provided by the lower sidewall level (66) is connected with the floor shell section (40) as shown in FIG. 7. Specifically, in the preferred embodiment, the second toe portions (72) of the lowermost shell member flanges (68) located on the sidewall shell members (60) comprising the lower sidewall level (66) are removed so that the floor shell section (40) may be connected with the first leg portions (70) of the flanges (68) using a plurality of fasteners.

Finally, referring to FIG. 6, where desired or required, a reinforcing member (74) may be connected, fastened or otherwise attached along one or more joints formed between the adjacent ends (55) of the sidewall shell members (60). The reinforcing member (74) may be provided to structurally reinforce the connection between the ends (55), as well as assist in maintaining the packing material (38) within the vessel housing (30). In the preferred embodiment, the reinforcing member (74) is comprised of the same material as the shell members (56), being galvanized steel. Further, the reinforcing member (74) extends between the adjacent ends (55) of the sidewall shell members (60) and is connected thereto using fasteners. Finally, in the preferred embodiment, the reinforcing member (74) extends along the entire joint length of the adjacent ends (55) to be connected. Thus, as shown in FIGS. 1–3, each reinforcing member (74) preferably extends from the upper edge (44) to the lower edge (43) of the sidewall shell section (42) along the entire joint.

As indicated, in the preferred embodiment, a plurality of fasteners are used throughout the system (20) to connect adjacent elements or members. In each case, any suitable fastener may be used, such as self-tapping screws, rivets or bolts. However, in the preferred embodiment, the fasteners are galvanized self-tapping screws with washers. Specifically, the screws are preferably self-tapping the screws. Further, the number of fasteners used in each particular location will vary depending upon the specific design and configuration of the overall system (20).

Figure 3:
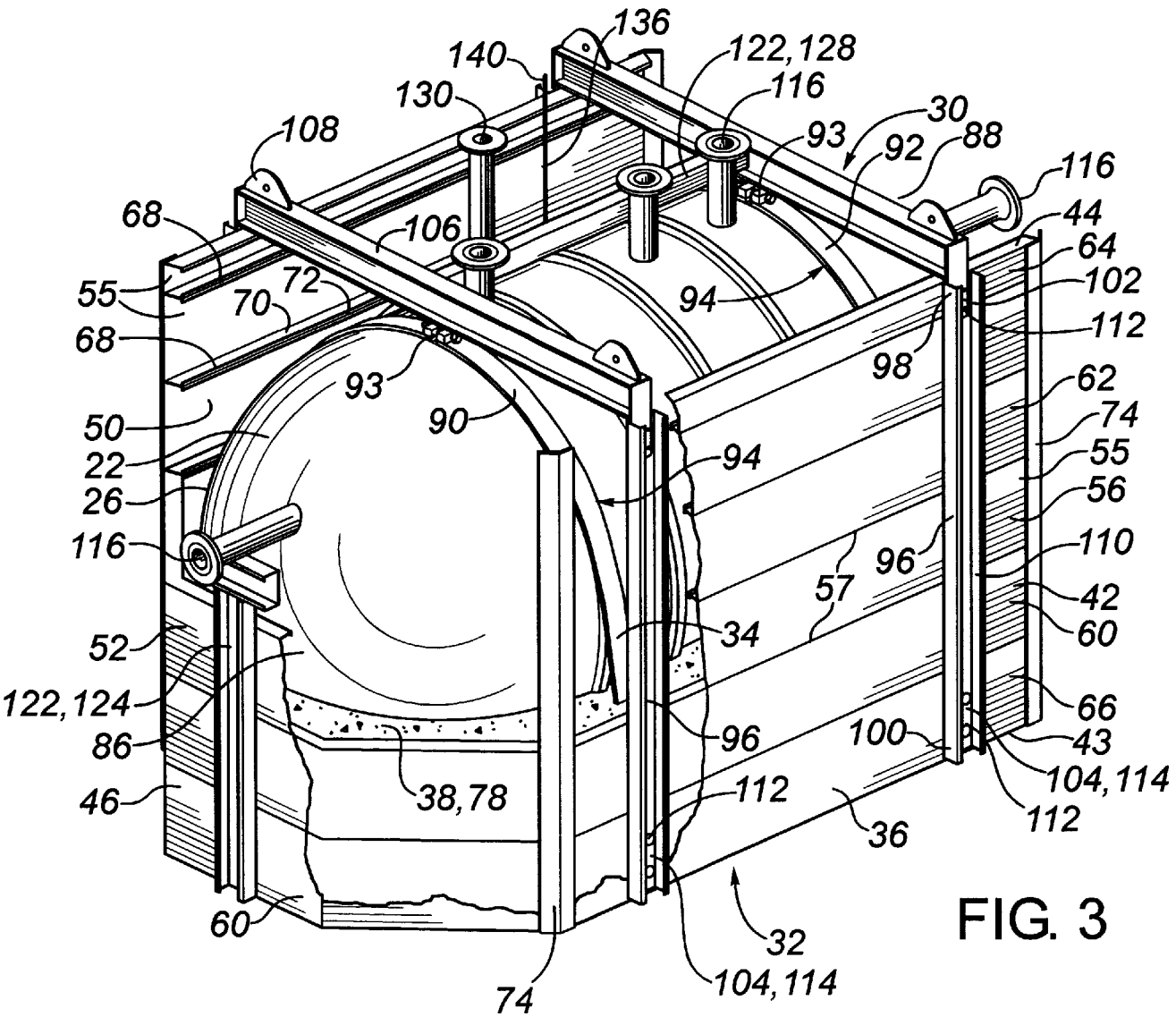
FIG. 3 is a further pictorial view of the preferred embodiment of the subterranean storage vessel system shown in FIG. 2, wherein the exterior shell has a cut-away portion to show the storage vessel and a lower layer of cementitious material comprising the packing material therein.

As stated, referring to FIGS. 1 and 3, the support structure (24) is comprised of the packing material (38). specifically, the packing material (38) is contained within the vessel housing (30) by the exterior shell (36). Further, the packing material (38) preferably substantially surrounds the storage vessel (22) in order to protect the storage vessel (22) and in order to support the storage vessel (22) such that the weight of the storage vessel (22) is transferred to the support structure (24). In the preferred embodiment, the storage vessel (22) and the packing material (38) together substantially fill the vessel housing (30).

As well, the packing material (38) also adds a weight of the system (20). In the preferred embodiment, the system (2) has a weight sufficient to overcome the upward buoyancy force of the system (20), in such circumstances, some form of secondary anchoring device may be required for the entire system (20).

The packing material (38) may be comprised of any material, including solids, liquids, gels and foams which can perform comprised of a lower layer (78) of a foundation packing material for supporting the storage vessel (22). The foundation packing material may be any material capable of supporting the storage vessel (22) such that the weight of the storage vessel (22), including its contents and every overburden, are transferred to the support structure (24).

In order to support the storage vessel (22), the lower layer (78) of a foundation packing material partially surrounds the storage vessel (22). The foundation packing material may be foundation packing material surrounds less than about seventy five percent of the exterior surface area (26) of the stored vessel (22). In the preferred embodiment, the lower layer (78) of the foundation packing material surrounds less than about fifty percent of the exterior surface area (26) of the storage vessel(22) so that the storage vessel (22) can be removed from the support structure (24) if necessary without first removing all or a portion of the foundation packing material.

In the preferred embodiment, the lower layer (78) of foundation packing material is comprised of a cementitious material. Although any cementitious material may be used, the cementitious material is preferably a relatively lightweight cellular concrete such as a lightweight cellular portland cement material. The lower layer (78) of cementitious material moulds or conforms to the exterior surface area (26) of the storage vessel (2) in order to support the stage cementitious material, the shell member flanges (68) reinforces the lower layer (78), by, in effect, providing a reinforced concrete slab. This reinforced concrete slab provides for a more rigid and unitary structure of the system (20). Further, the preferred configuration of the shell member flanges (68) to include a first leg portion (70) and a second toe portion (72) portion further enhances the reinforcement of the lower layer (78).

Where the lower layer (78) is comprised of a cementitious material, at least the portion of the storage vessel (22) surrounded by the cementitious layer is preferably comprised of a coating or a layer of plastic or some other material for minimizing any adhering or bonding of the storage vessel (22) with the cementitious material. As a result when it is desired or required to remove the storage vessel (22) from the system (20), the storage vessel (22) may be relatively easily removed from the layer or coating, which remains within the lower layer (78). In the preferred embodiment, the coating or layer is comprised of polyethylene.

As stated, one of the functions of the lower layer (78) is to support the storage vessel (22) such that any downward gravitational force applied to the storage vessel (22) may be transferred to the support structure (24). This downward gravitational force may create bending moments which tend to cause the storage vessel (22) to buckle or sag between its ends if the storage vessel (22) is not suspended therebetween. In addition, any support points for the storage vessel (22) create the potential for point loading, which can place high stresses on the storage vessel (22) due to concentration of the downward gravitational force over a small bearing area. As a result, the lower layer (78) of cementitious material supports the storage vessel (22) substantially evenly along the entire vessel length in order to distribute the downward gravitational force over as much of the exterior surface area (26) of the storage vessel (22) as is practical and so that deflection of the storage vessel (22) can be avoided.

The packing material (38) preferably substantially surrounds the storage vessel (22). Further, in the preferred embodiment, the storage vessel (22) and the packing material (38) substantially fill the vessel housing (30) between the upper and lower edges (44, 43) of the sidewall hell section (42) of the exterior shell (36). The packing material (38) above the lower layer (78) of cementitious material is comprised of the particulate material (76).

Any particulate material (76) may be used which is capable of protecting the storage vessel (22). For instance, the particulate material (76) may be comprised of one or both of an aggregate or rubber particles. In the preferred embodiment, the packing material (38) is comprised of the lower layer (78) of cementitious material to provide support to the storage vessel (22), an intermediate layer (80) of the particulate material (76) to provide protection to the storage vessel (22) and an upper layer (82) of the particulate material (76) to provide protection to the storage vessel (22). More preferably, the intermediate layer (80) is comprised of rubber particles, while the upper layer (82) is comprised of aggregate. Any aggregate may be used, however, the aggregate is preferably comprised of pea grave. Further, the rubber particles may be derived from recycled rubber.

As well, the support structure (24) is comprised of the vessel anchor (34) as shown in FIGS. 1 and 3–6. The function of the vessel anchor (34) is to anchor the storage vessel (22) against an upward buoyancy force extend on the storage vessel (22) when the infiltrating fluid at least partly submerges the storage vessel (22), such that the upward buoyancy force is transferred to the support structure (24).

It may be expected that the net upward buoyancy force that may be experienced by the storage vessel (22) will typically be less than downward gravitational force that may be experienced by the storage vessel (22), since the weight of the submerging medium above the storage vessel (22) may offset some of the upward buoyancy force. As a result, it may not be as important to evenly distribute the upward buoyancy force as it is to evenly distribute the downward gravitational force, since any bending moments and point loading produced by the upward buoyancy force may be unlikely to cause damage to the storage vessel (22).

The vessel anchor (34) may be comprised of at least one holddown strap which extends around the storage vessel (22) and is associated with the support structure (24) for anchoring the storage vessel (22) to the support structure (24). The vessel anchor (34) may also be comprised of any other holddown device which can connect or affix the storage vessel (22) with the support structure (24) such that the upward buoyancy force applied to the storage vessel (22) can be transferred to the support structure (24). For example, the storage vessel (22) may be bolted, welded or screwed to the vessel anchor (34), or the vessel anchor (34) may be comprised of a member or members which engages the storage vessel (22) to perform the anchoring function without being fixed to the storage vessel (22).

However, preferably the vessel anchor (34) is comprised of at least one holddown device. In the preferred embodiment, the vessel anchor (34) is comprised of two holddown devices which anchor the storage vessel (22) to the support structure (24) between a first vessel end (86) and a second vessel end (88) of the storage vessel (22). In the preferred embodiment, the holddown devices are comprised of two or more holddown straps. Referring to FIGS. 1–6, first holddown strap (90) is located adjacent to the first vessel end (86) and a second holddown strap (92) is located adjacent to the second vessel end (88).

Each of the holddown straps (90, 92) consists of two lengths of strap which are joined together with a holddown strap connector (93). The holddown strap connectors (93) may be comprised of any suitable structure of mechanism.

In the preferred embodiment, each holddown strap connector (93) is comprised of two steel members which are welded to the ends of each of the lengths of holddown step. The two steel members are provided with holes. A threaded bolt or shaft extends through the holes in the two steel members. The threaded shaft is retained in place relative to the steel members with threaded nuts on either end so that the lengths of holddown strap can also be held together. The holddown strap may thus be tightened and loosened by turning the threaded shaft and/or the nuts.

Referring to FIGS. 1–4, the two lengths of strap extend transversely around the storage vessel (22) and are joined together by the holddown strap connectors (93). The holddown straps (90, 92) preferably fit along a reinforcing rib (94) formed on the exterior surface area (26) of the storage vessel (22). In the preferred embodiment, the holddown straps (90, 92) are constructed of galvanized steel. The holddown straps could, however, be constructed of fiberglass or any other suitable material. Preferably a layer of neoprene rubber (not shown) is provided at the positions of contact between each holddown strap (90, 92) and the exterior surface (26) of the storage vessel (22).

The lower ends of the holddown straps (90, 92) are preferably connected with the support structure (24) in the manner described further below. The holddown straps (90, 92) may, however by incorporated into or connected with the support structure (24) in any manner.

The storage vessel system (20) is designed in order to permit the lifting of the system (20) without applying any lifting forces directly to the storage vessel (22). For instance, the lifting forces may be applied directly to the exterior shell (36) of the support structure (24). However, preferably, the support structure (24) is further comprised of at least one pair of lifting columns (96), wherein each of the lifting columns (96) is connected to the sidewall shell section (42) as shown in FIGS. 1–3. Further, each of the pair of lifting columns (96) is preferably connected to the sidewall shell section (42) in a manner and at a location to permit the storage vessel system (20) to be lifted by applying the lifting force to the lifting columns (96) rather than directly to the exterior shell (36).

Each of the pair of lifting columns (96) has an upper end (98) and a lower end (100). Preferably, the lifting force is applied to the lifting columns (96) at or adjacent to the upper ends (98). Further, each of the pair of lifting columns (96) may have any length and may extend for any distance along the sidewall shell section (42). For instance, each lifting column (96) may extend for any distance between the upper and lower edges (44, 43) of the sidewall shell section (42). However, in the preferred embodiment, each of the lifting columns (96) preferably extends substantially between the upper and lower edges (44, 43) of the sidewall shell section (42). Further, although each of the pair of lifting columns (96) may have may orientation, the pair of lifting columns (96) is preferably oriented substantially perpendicularly to the longitudinal axes of the sidewall shell members (58), as well as the upper and lower edges (44, 43) of the sidewall shell section (42).

Each of the pair of lifting columns (96) may be connected with the sidewall shell section (42) at one or more locations along the length of the lifting column (96) between its upper and lower ends (98, 100). As discussed previously, the adjacent shell members (56) of the exterior shell (36) are preferably connected at the shell member flanges (68) in a manner such that the exterior shell (36) is comprised of a lighting structure. Thus as a result of the structural integrity of the exterior shell (36), the exterior shell (36) preferably carries at least a portion of the lifting forces applied to the storage vessel system (20).

In the preferred embodiment, the storage vessel system (20) is designed so that lifting forces are applied and distributed between the exterior shell (36) and the lifting columns (96). Accordingly, the strength requirements of each of the exterior shell (36) and the lifting columns (96) individually may be minimized. As a result, each of the lifting columns (96) is preferably connected with the sidewall shell section (42) at two or more locations along the length of the lifting column (96) so that the lifting columns (96) and the exterior shell (36) can function as an integral lifting structure between the points or locations of connection.

In the preferred embodiments, each of the pair of lifting columns (96) is connected to the sidewall shell section (42) at both the upper sidewall level (64) and at the lower sidewall level (66). More particularly, the upper end (98) of each lifting column (96) is connected with the upper sidewall level (64) at an upper connection location (102), while the lower end (100) of each lifting column (96) is connected with the lower sidewall level (66) at a lower connection location (104).

In the preferred embodiment, the support structure (24) is further comprised of a lifting beam (106) connecting the pair of lifting columns (96) at a pair of connection locations adjacent to the upper ends (98) of the lifting columns (96). Although the pair of connection locations may be at any position or location along the lengths of the lifting columns (96), in the preferred embodiment, the lifting columns (96) are connected with the lifting beam (106) at the upper connection locations (102) between the lifting columns (96) and the upper sidewall level (64) so that the pair of lifting columns (96), the lifting beam (106) and the sidewall shell section (42) are all connected at the same upper connection location (102) as shown in FIGS. 1–3.

As a result, the lifting beam (106) facilitates the lifting of the storage vessel system (20) by applying the lifting force directly to the lifting beam (106). Further, each lifting beam (106) is preferably comprised of at least one lifting lug (108), and preferably two or more lifting lugs (108), for connecting the lifting beam (106) with a crane or other lifting apparatus.

As stated, the support structure (24) may be comprised of one pair of lifting columns (96) connected by one lifting beam (106). However, preferably as shown in FIG. 1, the support structure (24) is comprised of two pairs of lifting columns (96) connected by two lifting beams (106) so that the lifting force can be balanced and distributed along the length of the storage vessel system (20). In the case of a large storage vessel (22), the support structure (24) may be comprised of more than two pair of lifting columns (96) and more than two lifting beams (106).

The lifting columns (96) may have any shape or configuration suitable for connection with the exterior shell (36) and the lifting beam (106) and may be comprised of any suitable material. However, preferably, the shape or configuration are similar to that of the shell members (56) such that the lifting columns (96) are also comprised of flanges (110). The lifting columns (96) are connected with the sidewall shell section (42) such that the flanges (110) protrude outwardly from the vessel housing (30). Similarly, the lifting columns (96) are preferably comprised of a material similar to the shell members (56). Thus, the lifting columns (96) are preferably comprised of galvanized steel.

The particular gauge (i.e., thickness) of the galvanized steel comprising the shell members (56) will be selected depending upon the location of the shell member (56) within the exterior shell (36) and the stresses or forces applied thereto. For instance, the sidewall shell members (60) comprising the lower sidewall level (66), and preferably one or more of the immediately adjacent sidewall levels (62), should tend to be thicker and thus have a lower gauge than the balance of the sidewall shell members (60). The greater thickness may be necessary to inhibit or prevent the bowing out or bulging of the sidewall shell section (42) upon pouring of the lower layer (78) of cementitious material therein. Further, following the subterranean installation of the system (20) a greater thickness may be desirable due to the increased soil pressures on the sidewall shell section (42) at greater depths.

In addition, as a result of the presence of the upper connection location (102), the sidewall shell members (60) comprising the upper sidewall level (64) may also similarly be comprised of lower gauge (i.e., thicker) galvanized steel. The balance of the sidewall shell members (60) comprising the remaining sidewall levels (62), the reinforcing members (74), the lifting columns (96) and the floor shell members (58) may be comprised of higher gauge (i.e., thinner) galvanized steel. For instance, the elements having a lower gauge may be 12 gauge, while the elements having a higher gauge may be 16 gauge.

The lifting beam (106) may also have any shape or configuration and be comprised of any material permitting the necessary lifting forces to be applied to the lifting beam (106). Preferably, the lifting beam (106) is comprised of an "I-beam" made of structural steel, as shown in FIG. 1.

The necessary connections at each of the upper and lower connection locations (102, 104) may be provided by one or more of any suitable connectors, fasteners or attachment mechanisms. In the preferred embodiment, each of the connection is provided by one or more bolts (112) extending through the adjacent surfaces to be connected. For instance, one or more bolts (112) are provided at each of the lower connection locations (104) for connecting the lower sidewall level (66) and the lifting column (96). Similarly, one or more bolts are provided at each of the upper connection locations (102) for connecting the upper sidewall level (64), the lifting column (96) and the lifting beam (106). The number of bolts and the particular bolt pattern at each of the connection locations (102, 104) will be selected depending upon the required shear strength during lifting.

For example, with respect to a system (20) for a 50 barrel storage vessel (22), each of the four lifting columns (96) will have the following bit (112) pattern. Four bolts (112) will be provided at the upper connection location (102), while two bolts (112) in the lower sidewall level (66) centered vertically and horizontally will be provided at the lower connection location (104). With respect to a system (20) for a 100 barrel storage vessel (22), each of the four lifting columns (96) will have the following bolt (112) pattern. Six bolts (112) will be provided at the upper connection location (102), while three bolts (112) in the lower sidewall level (66) centered vertically and horizontally will be provided at the lower connection location (104).

In the preferred embodiment, the ends of the holddown straps (90, 92) are connected with the support structure (24). Specifically, the ends of the holddown straps (90, 92) are preferably connected with the sidewall shell section (42) and the lifting column (96) at a holddown strap connection location (114). The holddown strap connection location (114) may be positioned at any point or location along the length of the lifting column (6) and at any sidewall level (62). For instance, as shown in FIGS. 4 and 6, the holddown strap connection location (114) may be the same as the lower connection location (104). However, the holddown strap connection location (114) may also be positioned between the upper and lower connection locations (102, 104). For instance, the holddown strap connection location (114) may be positioned at the second lowermost sidewall level (62), being the sidewall level (62) immediately adjacent the lower sidewall level (66).

The necessary connection at the holddown strap connection location (114) may be provided by one or more of any suitable connectors, fasteners or attachment mechanisms. In the preferred embodiment, the holddown strap connection is provided by one or more bolts (112) extending through the sidewall shell section (42), the lifting column (96) and the end of the holddown strap (90, 92).

Referring to FIGS. 1–4, the storage vessel (22) may be further equipped with at least one fitting (116). The fitting (116) facilitates access to the interior chamber (28) of the storage vessel (22) and may be used for an inlet, an outlet, gauge access, leak detection, pressure relief, as a drop tube, still well, standpipe or for any other purpose. These fittings (116) may be located at the ends of the storage vessel (22) or they may be located between the ends of the storage vessel (22).

Referring to FIGS. 1–4, in the preferred embodiment, the support structure (24) further comprises a fitting anchor (118) for connecting the fitting (116) with the support structure (24) so that a fitting force applied to the fitting (116) is transferred to the support structure (24). Each fitting anchor (118) transfer the fitting force associated with a particular fitting (116) to the support structure (24) so that the fitting force creates stresses in the support structure (24) and not in the storage vessel (22).

In the preferred embodiment, each fitting anchor (118) is comprised of a bracket (120) which connects a particular fitting (116) with an adjacent fitting support member (122) connected or affixed with the support structure (24). The fitting anchors (118) may, however, be comprised of any device which can transfer the fitting force to the support structure (24). For example, the fitting anchors (116) may be straps, flanges, or welds.

in the preferred embodiment, the storage vessel (22) is equipped with a fitting (116) at the first vessel end (86) which extends through an opening defined by the first shell end (46) of the exterior shell (36). This fitting (116) is connected by a bracket (120) with a first fitting support member (124) mounted or connected with the exterior surface (52) of the exterior shell (36) at the first shell end (46) adjacent the opening therein. The storage vessel (22) is further equipped with a fitting (116) at the second vessel end (88) which extends through an opening defined by the second shell end (48) of the exterior shell (36). This fitting (116) is connected by a bracket (120) with a second fitting support member (not shown) mounted or connected with the exterior surface (52) of the exterior shell (36) at the second shell end (48) adjacent the opening therein. Finally, the storage vessel (22) is equipped with a plurality of fittings (116) between the vessel ends (86, 88) which are each connected by a bracket (120) with a third fitting support member (128). The third fitting support member (128) extends between and is connected or mounted with the lifting beams (106).

It may not be necessary to provide fitting anchors (118) is the fitting (116) is not intended to be rigidly connected with other piping, since the fitting (116) in such circumstances will tend to move freely with the storage vessel (22) and dangerous stresses may not develop. In the preferred embodiment, one of the fittings (116) is a standpipe (130) for which a fitting anchor (118) is optional.

The fittings (116) may be of any length. In the preferred embodiment, the system (20) is assembled with relatively short fittings (116) and risers are added as needed during installation of the system (20) so that the fittings (116) can be accessed following installation.

Finally, referring to FIGS. 5–7, the system (20) may be further comprised of a vacuum breaker (132) associated with the floor shell section (40) for communicating an equalizing fluid to an interface between the bearing surface (32) and the ground. Thus, the vacuum breaker (132) is particularly useful during the installation and removal of the storage vessel system (20). For instance, during installation, the vacuum breaker (132) provides an outlet for relief of any excess pressure at the interface between the bearing surface (2) and the ground. During removal, the vacuum beaker (132) provides an inlet for delivering or communications the equalizing fluid to the interface in order to overcome any suction forces at the interface interfacing with or inhibiting the removal of the system (20).

The vacuum breaker (132) may be comprised of any structure or any mechanism capable of communicating the equalizing fluid to be interface and preferably, capable of releasing any excess pressure from the interface. However, referring to FIGS. 5–7, the vacuum breaker (1320) is preferably comprised of at least one vacuum breaker port (134) in the floor shell section (40) and at least one vacuum breaker conduit (136) associated with the vacuum breaker port (134). The vacuum breaker conduit (136) preferably has a lower end (138) which is connected with the vacuum breaker port (134) and an upper end (140). The lower end (138) may be connected with the vacuum breaker port (134) in any manner permitting the passage of the equalizing fluid between the conduit (136) and the port (134) to permit or provide for communication with the interface.

Further, the vacuum breaker (132) may be comprised of any structure or any mechanism (134) to the upper end (140). Preferably, the upper end (140) is positioned or located such that it is readily accessible during installation and removal of the system (20). In the preferred embodiment, the upper end (140) of the conduit (136) is accessible form a location which is exterior of the vessel housing (30). Thus, the upper end (140) may extend from the vessel housing (30) through the exterior shell (36). However, preferably, the upper end (140) of the conduit (136) extends from the vessel housing (30) through the top of the vessel housing (30) defined by the upper edge (44) of the sidewall shell section (42).

Accordingly, in the preferred embodiment, the vacuum breaker conduit (136) extends from a lower end (138) connected with the port (134) in the floor shell section (40), along the side of the storage vessel (22) between the exterior surface area (26) of the storage vessel (22) and the interior surface (52) of the sidewall shell section (42) and to an upper end (140) extending beyond the upper edge (44) of the sidewall shell section (42) to a location exterior to the vessel housing (30).

The within invention also relates to a method for constructing a storage vessel system (20) comprising a storage vessel (22) and a support structure (24). Further, the method relates to the construction of a storage vessel system (20) which may be comprised of any suitable storage vessel (22) and any suitable support structure (24) capable of performing the functions described herein. However, preferably, the method of the within invention is used to construct a storage vessel system (20) comprised of the preferred embodiments of the storage vessel (22) and the support structure (24) as described previously.

The method is comprised of providing the floor shell section (40). Preferably, the floor shell section (40) providing step is comprised of the step of connecting adjacent floor shell members (58) to form the desired floor shell section (40). More particularly, in the preferred embodiment, the adjacent floor shell members (58) are connected by connecting the members (58) at the shell member flanges (68), preferably by fastening together the adjacent first leg portions (70) of the flanges (68).

The method is further comprised of connecting at least one sidewall level (62) of the sidewall shell section (42) to the floor shell section (40). Specifically, in the preferred embodiment, at least the lower sidewall level (66)is provided by connecting the adjacent ends (55) of the sidewall shell members (60) of the particular sidewall level (66) together, preferably by fastening the overlapping portions of the shell member flanges (68) as described above, to form the complete sidewall level (66). The lowermost side (67) of the lower sidewall level (66) defining the lower edge (43) of the sidewall shell section (42) is then connected with the floor shell section (40). In the preferred embodiment, the floor shell section (40) is connected with lowermost shell member flange (68), preferably by removing the second toe portion (72) of the flange (68) and fastening the exterior surface (52) of the floor shell section (40) to the first leg portion (70) of the flagen (68).

Where desired, one or more further sidewall levels (62) may then be horizontally disposed on top of the lower sidewall level (66). Thus, the method may comprise the further steps of providing the further sidewall levels (62), in the same manner as providing the lower sidewall level (66), and connecting the adjacent sidewall levels (62) of the sidewall shell section (42) to each other. More particularly, in the preferred embodiment, the adjacent sidewall shell members (60) of the sidewall levels (62) are connected by connecting the members (60) at the shell member flanges (68), preferably by fastening together the adjacent first leg portions (70) of the flanges (68).

At least one pair of lifting columns (96), and preferably two pairs of lifting columns (96), are then connected to the sidewall shell section (42). Preferably, the lifting columns (96) connecting step is comprised of connecting the lifting columns (96) to the lower sidewall level (66) of the sidewall shell section (42). In the preferred embodiment, the lifting columns (96) are connected to the lower sidewall level (66) by fastening the lifting columns (96) to the adjacent sidewall shell member (60) at the lower connection location (104).

The method further includes the step of connecting the vessel anchor (34), comprised of at least one holddown strap, to the pair of lifting columns (96). In the preferred embodiment, two holddown straps (90, 92) are connected to the two pairs of lifting columns (96). Preferably, the vessel anchor (34) connecting step is comprised of fastening the ends of the holddown straps (90, 92) with the sidewall shell section (42) and the lifting column (96) at the holddown strap connection location (114).

Preferably, the storage vessel (22) is then placed within the sidewall shell section (42) in spaced relation to floor shell section (40). In other words, a spaced distance is provided between the exterior surface area (26) of the storage vessel (22) and the interior surface (50) of the floor shell section (42). In the preferred embodiment, the storage vessel placing step is comprised of positioning the storage vessel (22) upon one or more storage vessel support members (54).

Once the storage vessel (22) is placed within the sidewall shell section (42), at least one holddown strap, and preferably both holddown straps (90, 92) are connected to the storage vessel (22) so that the storage vessel (22) is anchored by the pair, and preferably the two pairs, of lifting columns (96).

The method further includes the step of placing the lower layer (78) of the foundation packing material, preferably a cementitious material, within the sidewall shell section (42) and between the floor shell section (40) and the storage vessel (22) so that the lower layer (78) of foundation packing material partially surrounds and supports the storage vessel (22).

In addition, the method further comprises the step of completing the sidewall shell section (42) so that the sidewall shell section (42) is comprised of a plurality of sidewall levels (62) and to provide the exterior shell (36) comprising the floor shell section (40) and the sidewall shell section (42). If desired, the completing step may be performed at any time following the lower sidewall level (66) connecting step and prior to the step of placing the lower layer (78) of the foundation packing material. Preferably, the completing step is performed following the step of placing the lower layer (78) of the foundation packing material. In any event, the completing step is comprised of horizontally disposing the remaining sidewall levels (62) upon the previously connected sidewall levels (62). Thus, the method may comprise the further steps of providing the further sidewall levels (62), in the same manner as providing the lower sidewall level (66), and connecting the adjacent sidewall levels (62) of the sidewall shell section (42) to each other. More particularly, in the preferred embodiment, the adjacent sidewall shell members (60) of the sidewall levels (62) are connected by connecting the members (60) at the shell member flanges (68), preferably by fastening together the adjacent first leg portions (70) of the flanges (68).

Following the completion of the sidewall shell section (42), the method preferably further comprises the step of connecting the lifting columns (96) to the upper sidewall level (64) of the sidewall shell section (42). In the preferred embodiment, the lifting columns (96) are connected to the upper sidewall level (64) by fastening the lifting columns (96) to the adjacent sidewall shell member (60) at the upper connection location (102).

Preferably, the method is further comprised of the step of also connecting the pair of lifting columns (96) with the lifting beam (106) at a pair of connection locations adjacent to the upper end (98) of each of the lifting columns (96). In the preferred embodiment, two lifting beams (106) are connected with the two pairs of lifting columns (96). Further, the pair of connection locations are preferably comprised of the upper connection locations (102). In other words, the lifting columns (96) are connected to the lifting beams (106) at the upper connection locations (102) between the lifting columns (96) and the upper sidewall level (64) of the sidewall shell section (42) so that the lifting columns (96), the lifting beams (106) and the sidewall shell section (42) are all connected at the same connection locations.

Further, following the completion of the sidewall shell section (42) and placing of the lower layer (78) of foundation packing material, the method further includes the step of substantially filling the exterior shell (36) with a particular material (76) in order to protect the storage vessel (22) and to provide the support structure (24), the support structure (24) defining the vessel housing (30) and comprising the holddown straps (90, 92), the exterior shell (36), the pair of the pairs of lifting columns (96), the lifting beam or beams (106), the lower layer (78) of foundation packing material and the particulate material (76).

As well, where the storage vessel (22) is comprised of at least one fitting (116) to facilitate access to the interior chamber (28) of the storage vessel (22), the method may be further comprised of the step of connecting the fitting (116) to a fitting anchor (118) located on the support structure (24). More particularly, in the preferred embodiment, the fitting (116) at the first vessel end (86) is connected by a bracket (120) with the first fitting support member (124) connected with the support structure (24). Further, the fitting (116) at the second vessel end (88) is connected by a bracket (120) with the third fitting support member (128) connected with the support structure (24).

Finally, the method may further comprise the step of providing the vacuum breaker (132). In the preferred embodiment, the vacuum breaker (132) providing step is comprised of providing at least one vacuum breaker (134) in the floor shell section (40) and at least one vacuum breaker conduit (136) having a lower end (138) which is connected to the vacuum breaker port (134).

The system (20) is preferably fabricated and assembled offsite and is then transported and installed as an integral unit. This enables the fabrication to be conducted in a more controlled environment such as a shop floor and potentially offers a superior storage vessel installation in comparison with conventional subterranean installations where the system (20) is not utilized and the storage vessel (22) is installed without the support structure (24). Preferably the metal components of the system (20) are rustproofed during fabrication and assembly and the system (20) is pressure tested and otherwise inspected before leaving the fabrication facility. If the weight of the complete system (20) is too great for the available lifting the device (not shown), all or some of the packing material (38) may be packed in the vessel housing (30) after the system (20) has arrived at its final destination.

The preferred installation procedure for the system(20) involves a number of simple steps, some of which can be performed before the system (20) arrives at the installation site and others which require the system (20) to be onsite. First, a hole is excavated with dimensions approximately one foot larger than the plan view dimensions of the storage vessel (22). The hole is excavated to a depth specified by applicable codes or by the manufacturer's instructions for the particular storage vessel (22). As previously indicated, the use of the preferred support structure (24) may enable the storage vessel (22) to be installed more shallow in comparison with conventional installations due to the support and protection provided by the support structure (24). The use of the support structure (24) as in the preferred embodiment may not, however, typically enable the storage vessel (22) to be installed deeper in comparison with conventional installations, since in the preferred embodiment the support structure (24) does not completely isolate the storage vessel (22) from the forces exerted on the storage vessel (22) by the submerging medium or infiltrating fluid.

Second, the bottom of the hole is leveled and compacted if desired. Third, the system (20) is lifted by the lifting lugs (108) on the lifting beams (106) and then lowered into the hole. Fourth, the system (20) is raised and lowered several times to ensure that the bottom of the hole is compacted sufficiently to support the system (20). If necessary, packing material (38) may be added to the vessel housing (30) if it is not already in the vessel housing (30). Fifth, any necessary risers are installed on the fittings (116). Sixth, the gap between the walls of the hole and the system (20) are filled with a suitable backfill material such as gravel or sand. Seventh, the portion of the hole above the system (20) is filled with a suitable backfill material such as material removed during excavation of the hole. Eighth, any piping which must be connected to the risers is connected and any associated instruments and equipment are also installed and connected to the system (20) as necessary. Last, any desired surface protection device for the system (20) is installed. If the desired surface protection device is a truck guard, piles are installed and any associated gate sections are connected to the piles.

The potential installation advantages of the system (20) over conventional subterranean storage vessel installations are many and include the following. First, damage to the storage vessel (22) during transportation, installation or removal of the system (20) in unlikely. Second, the system (20) may be installed without workers in the hole during the installation procedure, thus resulting in a safer installation procedure. Third, the size of the hole may be reduced since a separate anchoring device is not normally required. Fourth, the requirements for backfill onsite will be lower than with conventional installations. Fifth, the system (20) may be installed under virtually any weather and soil conditions, including wet soil conditions without the buoyancy and shoring concerns associated with conventional installations. Sixth, the installation time can be greatly reduced in comparison with conventional installations, since site preparation requirements can be significantly minimized. Seventh, the system (20) may often be reused after it has been removed from the hole since it can be removed as an integral unit without disassembly.

The embodiments of the invention in which an exclusive property or privilege is claimed are defined as follows:

1. A storage vessel system for subterranean installation in ground, the system comprising:

(a) a storage vessel having a weight;

(b) a support structure connected with the storage vessel, wherein the support structure defines a vessel housing, wherein the storage vessel is contained within the vessel housing, and wherein the support structure is comprised of:

(i) a bearing surface adapted for contacting the ground such that the system is supported on the ground;

(ii) a vessel anchor for anchoring the storage vessel against an upward buoyancy force exerted on the storage vessel when an infiltrating fluid at least partly submerges the storage vessel, such that the upward buoyancy force is transferred to the support structure;

(iii) a permeable exterior shell which permits the infiltrating fluid to infiltrate the vessel housing such that the upward buoyancy force is exerted on the storage vessel; and (iv) a packing material contained within the vessel housing by the exterior shell, the packing material substantially surrounding the storage vessel in order to protect the storage vessel and in order to support the storage vessel such that the weight of the storage vessel is transferred to the support structure.

2. The system as claimed in claim 1 wherein the packing material is comprised of a particulate material, wherein the packing material is further comprised of a lower layer of a foundation packing material for providing a vessel support, and wherein the lower layer of foundation packing material partially surrounds the storage vessel.

3. The system as claimed in claim 2 wherein the particulate material is comprised of aggregate.

4. The system as claimed in claim 3 wherein the particulate material is further comprised of rubber particles.

5. The system as claimed in claim 4 wherein the foundation packing material is comprised of a cementitious material and wherein the packing material is comprises of a lower layer of the cementitious material, an intermediate layer of rubber particles, and an upper layer of aggregate.

6. The system as claimed in claim 2 wherein the particulate material is comprised of rubber particles.

7. The system as claimed in claim 2 wherein the storage vessel has an exterior surface area and wherein the lower layer of the foundation packing material surrounds less than about seventy five percent of the exterior surface area of the storage vessel.

8. The system as claimed in claim 2 wherein the foundation packing material is comprised of a lightweight cellular portland cement material.

9. The system as claimed in claim 2 wherein the exterior shell is comprised of a floor shell section and a sidewall shell section.

10. The system as claimed in claim 9 wherein the bearing surface is comprised of the floor shell section.

11. The system as claimed in claim 10 wherein the storage vessel is separated from the floor shell section by the foundation packing material.

12. The system as claimed in claim 11 wherein the exterior shell is comprised of a plurality of shell members.

13. The system as claimed in claim 12 wherein the shell members are comprised of a plurality of floor shell members and a plurality of sidewall shell members.

14. The system as claimed in claim 13 wherein each of the floor shell members and the sidewall shell members is comprised of a pair of shell member flanges which protrude into the vessel housing.

15. The system as claimed in claim 14 wherein adjacent shell members are connected together so that the exterior shell is comprised of a lifting structure.

16. The system as claimed in claim 15 wherein the sidewall shell members are horizontally disposed on top of each other so that the sidewall shell section is comprised of a plurality of sidewall levels.

17. The system as claimed in claim 16 wherein the support structure is further comprised of at least one pair of lifting columns, wherein each of the pair of lifting columns is connected to the sidewall shell section.

18. The system as claimed in claim 17 wherein each of the pair of lifting columns has an upper end and a lower end and wherein the support structure is further comprised of a lifting beam connecting the pair of lifting columns at a pair of connection locations adjacent to the upper ends of the lifting columns.

19. The system as claimed in claim 18 wherein the plurality of sidewall levels is comprised of an upper sidewall level and a lower sidewall level and wherein each of the pair of lifting columns is connected to the sidewall shell section at the upper sidewall level and at the lower sidewall level.

20. The system as claimed in claim 19 wherein the support structure is comprised of at least two pairs of lifting columns and at least two lifting beams.

21. The system as claimed in claim 20 wherein the lifting columns are connected to the upper sidewall level at the connection locations between, the lifting columns and the lifting beams so that the lifting columns, the lifting beams and the sidewall shell section are all connected at the connection locations.

22. The system as claimed in claim 15 wherein the shell members are comprised of galvanized steel.

23. The system as claimed in claim 11, further comprising a vacuum breaker associated with the floor shell section for communicating an equalizing fluid to an interface between the bearing surface and the ground.

24. The system as claimed in claim 23 wherein the vacuum breaker is comprised of at least one vacuum breaker port in the floor shell section and at least one vacuum breaker conduit having a lower end which is connected to the vacuum breaker port.

25. The system as claimed in claim 24 wherein the vacuum breaker conduit extends from the vacuum breaker port such that an upper end of the vacuum breaker conduit is accessible from a location which is exterior of the vessel housing.

26. The system as claimed in claim 11 wherein the storage vessel and the packing material together substantially fill the vessel housing.

27. The system as claimed in claim 2 wherein the vessel anchor is comprised of at least one holddown device associated with the support structure for anchoring the storage vessel to the support structure.

28. The system as claimed in claim 27 wherein the holddown device is comprised of at least one holddown strap which connects the storage vessel to the support structure.

29. The system as claimed in claim 28 wherein the storage vessel has a first vessel end and a second vessel end and wherein the vessel anchor is comprised of a first holddown strap and a second holddown strap which connect the storage vessel with the support structure between the first vessel end and the second vessel end.

30. The system as claimed in claim 2 wherein the storage vessel defines an interior chamber, wherein the storage vessel is further comprised of at least one fitting to facilitate access to the interior chamber, and wherein the support structure further comprises a fitting anchor for connecting the fitting with the support structure so that a fitting force applied to the fitting is transferred to the support structure.

31. The system as claimed in claim 2 wherein the storage vessel is constructed of a corrosion resistant material.

32. The system as claimed in claim 31 wherein the corrosion resistance material is comprised of fiberglass.

33. A method for constructing a storage vessel system comprising a storage vessel and a support structure, the method comprising:

(a) providing a floor shell section;

(b) connecting at least one sidewall level of a sidewall shell section to the floor shell section;

(c) connecting at least one pair of lifting columns to the sidewall shell section;

(d) connecting a vessel anchor to each of the pair of lifting columns, wherein the vessel anchor is comprised of a holddown strap;

(e) placing the storage vessel within the sidewall shell section in spaced relation to the floor shell section;

(f) connecting the holddown strap to the storage vessel so that the storage vessel is anchored by the pair of lifting columns;

(g) placing a lower layer of a foundation packing material within the sidewall shell section and between the floor shell section and the storage vessel so that the lower layer of foundation packing material partially surrounds and supports the storage vessel;

(h) completing the sidewall shell section so that the sidewall shell section is comprised of a plurality of sidewall levels and to provide an exterior shell comprising the floor shell section and the sidewall shell section;

(i) connecting the pair of lifting columns with a lifting beam at a pair of connection locations adjacent to an upper end of each of the lifting columns; and (j) substantially filing the exterior shell with a particulate material in order to protect the storage vessel and to provide the support structure, the support structure defining a vessel housing and comprising the holddown strap, the exterior shell, the pair of lifting columns, the lifting beam, the lower layer of foundation packing material and the particulate material.

34. The method as claimed in claim 33, further comprising the step of providing at least one vacuum breaker port in the floor shell section and at least one vacuum breaker conduit having a lower end which is connected to the vacuum breaker port.

35. The method as claimed in claim 33, further comprising the step of connecting adjacent levels of the sidewall shell section to each other.

36. The method as claimed in claim 35 wherein the floor shell section is comprised of a plurality of floor shell members, wherein the sidewall shell section is comprised of a plurality of sidewall shell members, and wherein each of the floor shell members and the sidewall shell members is comprised of a pair of shell member flanges which protrude into the vessel housing.

37. The method as claimed in claim 36, further comprising the steps of connecting adjacent floor shell members at the shell member flanges and connecting adjacent sidewall shell members at the shell member flanges.

38. The method as claimed in claim 33 wherein the support structure is comprised of at least two pairs of lifting columns, at least two lifting beams and at least two holddown straps.

39. The method as claimed in claim 38 wherein the plurality of sidewall levels is comprised of a lower sidewall level and an upper sidewall level and wherein the step of connecting the lifting columns to the sidewall shell section is comprised of connecting the lifting columns to the lower sidewall level of the sidewall shell section.

40. The method as claimed in claim 39, further comprising the step of connecting the lifting columns to the upper sidewall level of the sidewall shell section.

41. The method as claimed in claim 40, further comprising the step of connecting the lifting columns to the upper sidewall level at the connection locations between the lifting columns and the lifting beams so that the lifting columns, the lifting beams and the sidewall shell section are all connected at the connection locations.

42. The method as claimed in claim 33 wherein the storage vessel defines an interior chamber and wherein the storage vessel is further comprised of at least one fitting to facilitate access to the interior chamber, further comprising the step of connecting the fitting to a fitting anchor located on the support structure.

* * * * *

UNITED STATES PATENT AND TRADEMARK OFFICE

CERTIFICATE OF CORRECTION

PATENT NO. : 6,514,009 B2
DATED : February 4, 2003
INVENTOR(S) : Robert William Northcott et al.

It is certified that error appears in the above-identified patent and that said Letters Patent is hereby corrected as shown below:

Column 1,
Line 29, change "Further" to -- Further, --

Column 2,
Line 49, change "of" to -- to --

Column 7,
Line 27, change "vessel" to -- storage vessel --

Column 15,
Line 50, change "(5)" to -- (50) --

Column 18,
Line 27, change "move" to -- more --
Line 47, change "sheet" to -- shell --

Column 20,
Line 1, change "the" to -- tek --
Line 6, change "specifically" to -- Specifically --
Line 16, change "of" to -- to --
Line 17, change "(2)" to -- (20) --
Line 19, change "of" to -- when --
Line 19, after "(20)" insert the following missing text

--is at least partly submerged and the storage vessel is empty. The weight of the system (20) can be adjusted by adjusting the types and amounts of packing material (38) which are used in the system (20).

If sufficient weight is provided, the system (20) will not require any secondary form of anchoring device. If the system (20) does not have sufficient weight to overcome the upward buoyancy force on the system (20),--

---

Line 25, after "perform", insert the following missing text
-- one or more of the intended functions of the packing material (38). Preferably, the packing material (38) is comprised of a particulate material (76). Further, the packing material (38) is preferably --
Line 33, change "The foundation packing material may be" to -- Preferably, the lower layer (78) of the --
Line 36, change "stored" to -- storage --
Line 49, change "(2)" to -- (22) --

UNITED STATES PATENT AND TRADEMARK OFFICE

CERTIFICATE OF CORRECTION

PATENT NO. : 6,514,009 B2
DATED : February 4, 2003
INVENTOR(S) : Robert William Northcott et al.

It is certified that error appears in the above-identified patent and that said Letters Patent is hereby corrected as shown below:

Column 20 (cont'd),
Line 50, change "stage" to -- storage vessel (22) -- and then insert the following missing text

--Further, as described above, the exterior surface area (26) of the storage vessel (22) is preferably a spaced distance from the interior surface (50) of the exterior shell (36). Specifically, in the preferred embodiment, the storage vessel (22) is separated from the floor shell section (40) of the exterior shell (36) by the cementitious material comprising the lower layer (78) so that the storage vessel (22) is supported by the cementitious material and not directly by the exterior shell (36).

In the preferred embodiment, prior to introducing the cementitious material, the storage vessel (22) is initially supported in the desired position within the exterior shell (36) by a storage vessel support. Any type or form of vessel support may be used which is capable of supporting the storage vessel (22) a spaced distance from the floor shell section (40). Specifically, in the preferred embodiment, the storage vessel (22) is preferably positioned just out of contact with the shell member flanges (68) extending from the floor shell members (58). Further, in the preferred embodiment, the vessel support is comprised of two or more vessel support members (54) positioned between the floor shell section (40) and the storage vessel (22). The vessel support members (54) are preferably comprised of a relatively lightweight material such as wood. Following placement and curing of the lower layer (78) of cementitious material, the vessel support members (54) reinforce the cementitious material.

Further, as described above, in the preferred embodiment, the shell member flanges (68) protrude into the vessel housing (30). Thus, at least a portion of the shell member flanges (68) protrude into the lower layer (78) of the cementitious material following placement of the cementitious material within the vessel housing (30). As a result, following curing of the--

Line 51, change "reinforces" to -- reinforce --

Column 21,
Line 10, change "suspended" to -- supported --
Line 26, change "hell" to -- shell --
Line 42, change "grave" to -- gravel --

Column 22,
Line 24, change "of" to -- or --
Line 27, change "step" to -- strap --

Column 23,
Line 39, change "embodiments" to -- embodiment --

Column 25,
Line 6, change "bit" to -- bolt --

UNITED STATES PATENT AND TRADEMARK OFFICE

CERTIFICATE OF CORRECTION

PATENT NO. : 6,514,009 B2
DATED : February 4, 2003
INVENTOR(S) : Robert William Northcott et al.

It is certified that error appears in the above-identified patent and that said Letters Patent is hereby corrected as shown below:

Column 26,
Line 1, change "in" to -- In --
Line 22, change "is" to -- if --
Line 45, change "communications" to -- communicating --
Line 64, change "(132) may be comprised of any structure or any mechanism" to -- conduit (136) extends from the vacuum breaker port --

Column 27,
Line 55, change "flagen" to -- flange --

Column 29,
Line 42, after "with the" insert the following missing text
-- second fitting support member (not shown) connected with the support structure (24). Finally, the plurality of fittings (116) between the vessel ends (86, 88) are each connected by a bracket (120) with --

Column 31,
Line 33, change "comprises" to -- comprised --

Signed and Sealed this

Twenty-fourth Day of August, 2004

JON W. DUDAS
*Director of the United States Patent and Trademark Office*